US006577207B2

(12) United States Patent
Volman

(10) Patent No.: US 6,577,207 B2
(45) Date of Patent: Jun. 10, 2003

(54) DUAL-BAND ELECTROMAGNETIC COUPLER

(75) Inventor: Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 53 days.

(21) Appl. No.: 09/971,428

(22) Filed: Oct. 5, 2001

(65) Prior Publication Data

US 2003/0067367 A1 Apr. 10, 2003

(51) Int. Cl.[7] ..... H01N 1/161
(52) U.S. Cl. ..... 333/125; 333/137; 333/21 A
(58) Field of Search ..... 333/110, 126, 333/135, 113, 111, 137, 202, 108, 114, 122, 125, 157, 21 A

(56) References Cited

U.S. PATENT DOCUMENTS 2,923,895 A * 2/1960 Curtis et al. ..... 333/137
3,327,250 A * 6/1967 Sleeper, Jr. ..... 333/21 R
3,922,621 A 11/1975 Gruner ..... 333/11
3,958,193 A * 5/1976 Rootsey ..... 333/125
4,720,691 A * 1/1988 Rammos ..... 333/122
6,097,264 A * 8/2000 Vezmar ..... 333/21 A
6,225,875 B1 * 5/2001 Kick ..... 333/125

* cited by examiner

*Primary Examiner*—Robert Pascal
*Assistant Examiner*—Dean Takaoka
(74) *Attorney, Agent, or Firm*—Duane Morris LLP

(57) ABSTRACT

A coupler couples signal by way of a cluster of four square waveguide ports at a high frequency band, or by way of a two ridged waveguide ports at a lower frequency band, to a common square port. The coupling path includes a branch coupler for combining the $TE_{2,0}$ and $TE_{0,2}$ high-band signals from the square ports with the $TE_{1,0}$ low-band signals from the two ridged ports. The branch coupler is coupled to a mode converter or transformer, which allows the $TE_{2,0}$ and $TE_{0,2}$ mode signals to pass through unchanged, and which converts the $TE_{1,0}$ mode signals from the two ridged ports to $TE_{1,0}$, $TE_{0,1}$ in a square port. A ridged square waveguide section couples the square port of the mode converter to the common square port. The ridged square waveguide section includes ridges and phase shifters which delay components of the high-band modes to produce $TE_{1,0}$ and $TE_{0,1}$ modes at the common port in both bands.

10 Claims, 13 Drawing Sheets

DUAL-BAND ELECTROMAGNETIC COUPLER

FIELD OF THE INVENTION

This invention relates to electromagnetic couplers, and especially to such couplers using mode transformation, and their use in conjunction with antenna arrangements.

BACKGROUND OF THE INVENTION

The invention arose out of consideration of the problems associated with the design of broadband antenna feed systems for use in spacecraft. Some current communication spacecraft operate in a transmit (Tx) band extending from 3.2 to 4.2 GHz and in a receive (Rx) band extending from 5.925 to 6.725 GHz. These bands may be referred to as a "4/6" GHz frequency band. The purpose of such couplers is to allow a single antenna to receive and transmit signals within its receive and transmit bands with isolation, and preferably high isolation, between Tx and Rx ports, or between the transmit and receive signals of two disparate frequency bands. Electromagnetic couplers for communications use tend to require a combination of broad bandwidth, low losses, isolation between Tx and Rx ports, light weight, simplicity and ruggedness. A compromise is ordinarily required among these and other limitations, such as cost.

Arrangements for frequency re-use of antennas are described beginning at page 371 and extending to page 445 of the text *Waveguide Components for Antenna Feed Systems: Theory and CAD*, by Uher et al., published 1993 by Artech House of Boston and London, ISBN 0-89006-582-9.

A coupler suitable for such use is described in U.S. Pat. No. 3,992,621, issued Nov. 25, 1975 in the name of Gruner. The Gruner arrangement includes an inner circular waveguide for propagating the 6 GHz signals and an outer circular waveguide for propagating the 4 GHz signals. The coupling section includes a plurality of inwardly projecting annular corrugations.

SUMMARY OF THE INVENTION

Thus, a coupler with mode transformer according to an aspect of the invention is for coupling (a) a common square waveguide port with at least one of nominally mutually independent (b) first external and (c) second external ports. The first external port is in the form of a cluster of first, second, third, and fourth clustered square waveguide ports. The second external port is in the form of first and second rectangular ridged waveguide ports, which are associated with corresponding waveguides. The first external port, in one embodiment, operates at a relatively high frequency band, namely 6 GHz, and the second external port operates at a relatively low frequency band, while the common port operates at both frequency bands. The common square waveguide associated with the common square waveguide port, and each of the four square clustered waveguides associated with the first external port, are capable of supporting either, or both, of two mutually orthogonal linear polarizations. In general, at any one time, one of the square waveguides may support a first linear polarization, a second linear polarization orthogonal to the first, or either of two hands of circular or elliptic polarization which has as components such linear polarizations. The second external port is in the form of first and second rectangular ridged waveguide ports, each of which is capable of supporting a single linear polarization, and each of which is associated with a corresponding ridged waveguide. The common port can couple signals with any of these polarizations with (or to) one or the other of the first and second nominally independent ports. The coupler includes a ridged square waveguide section defining a port coupled to, or in common with, the common square waveguide port and also defining a first internal square port. The ridged square waveguide section includes first and second mutually spatially orthogonal ridge structures lying between the first and first internal square ports of the ridged square waveguide section. These ridge structures tend to concentrate the fields of the dominant $TE_{1,0}$ mode of either of the two mutually spatially orthogonal linear polarizations in, or into, a region near the axis or center of the ridged square waveguide section. The ridged square waveguide section also includes first and second planar phase shifters. The first planar phase shifter lies parallel to the plane of the first ridge structure, and the second planar phase shifter lies parallel with the plane of the second ridge structure, so that the first and second planar phase shifters are mutually orthogonal. Each of the first and second planar phase shifters is located between that one of the ridge structures with which it is parallel and a side wall of the ridged square waveguide section. The locations of the phase shifters are selected for propagating either polarization of the dominant $TE_{1,0}$ mode from the first port to the second port of the ridged square waveguide section without substantially affecting the dominant $TE_{1,0}$ mode, and for delaying by substantially $\pi$ a spatial portion of one of (a) a $TE_{2,0}$ and (b) a $TE_{0,2}$ mode propagating therein, to thereby convert between the dominant $TE_{1,0}$ mode at the first port of the square waveguide section and the one of the (a) $TE_{20}$ and (b) $TEO_{0,2}$ mode at the second port of the square waveguide section. The coupler includes a transition section of waveguide. The transition section of waveguide defines a first internal square waveguide port which is coupled to the first, internal, square waveguide port of the ridged square waveguide section, and also defines a second square waveguide internal port. The transition section of waveguide includes a first septum extending completely across the square cross-section at the second internal port of the transition section of waveguide to thereby define first and second internal rectangular waveguide ports. The first septum progressively reduces in size (becomes smaller) toward the first square waveguide port of the transition section of waveguide. The transition section of waveguide converts between either polarization of the $TE_{1,0}$ mode at the first internal square port of the ridged waveguide section and at least one of the $TE_{2,0}$ and $TE_{0,2}$ modes in the first and second internal rectangular ports of the transition section. The coupler further includes an eight-port waveguide branch section defining the first and second rectangular ridged waveguide ports of the second nominally independent port of the coupler. The branch section also includes first, second, third, and fourth clustered square waveguide ports of the first nominally independent port of the coupler, and third and fourth internal rectangular waveguide ports having a common or joined wall. The third and fourth internal rectangular waveguide ports of the branch section are coupled to the first and second internal rectangular waveguide ports of the transition waveguide section. The branch section further defines first and second H-plane walls parallel with the common wall, a first E-plane rectangular aperture in the first H-plane wall which is coupled to the first rectangular waveguide port of the second nominally independent port of the coupler, and a second rectangular aperture in the second H-plane wall which is coupled to the second rectangular waveguide port of the second nominally independent port of the coupler. The branch section further includes a second septum extending from that edge of the first rectangular aperture which is adjacent the first nominally independent waveguide port to the first nominally independent waveguide port, to thereby aid in defining the first and second clustered square waveguide ports, and further includes a third septum extending from that edge of the second rectangular aperture which is adjacent the first nominally independent waveguide port to the first nominally independent waveguide port, to thereby aid in defining the third and fourth clustered square waveguide ports.

In a particular avatar of this aspect of the invention, the coupler includes a first rectangular waveguide section extending from the first rectangular aperture to the first rectangular waveguide port of the second nominally independent port of the coupler. This particular avatar also includes a third ridge which extends through the first rectangular aperture on that side of the first rectangular aperture which is remote from the first nominally independent waveguide port. This third ridge extends, in contact with a wall of the first rectangular waveguide section at least part-way from the first rectangular waveguide aperture to the first rectangular waveguide port. A variant of this particular avatar has the third ridge extending, in contact with the first H-plane wall, from the first rectangular aperture toward the first rectangular internal port of the branch section.

In another avatar of this aspect of the invention, the first rectangular aperture in the first H-plane wall of the branch section of the coupler has at least one of height and width dimensions, in a direction transverse to the direction of propagation therethrough, less than the corresponding dimension of the third internal rectangular waveguide port.

The second septum of the branch section of the coupler may include a tapered portion extending generally across, but not in contact with, the first rectangular aperture in the first H-plane wall. This second septum may be in contact with the common wall of the waveguide associated with the third internal rectangular waveguide port.

The ridge structure of ridged square waveguide section of the coupler, in a region lying between the first or external port and the first internal port of the ridged square waveguide section may include first and second mutually coplanar ridge portions in electrical contact with mutually opposed walls of the ridged square waveguide section. In a is particular variant, the first ridge structure lying between the first and first internal ports of the ridged square waveguide section further comprises a third planar ridge portion (part of the central ridge structure) coplanar with the first and second mutually coplanar ridge portions, which third planar ridge portion is centered in the ridged square waveguide section and not in electrical contact with any wall of the ridged square waveguide section. This third planar ridge portion may be supported by a dielectric support structure. In one hypostasis of the invention, the planar phase shifter is in the form of a dielectric plate.

DESCRIPTION OF THE INVENTION

Figure 1:
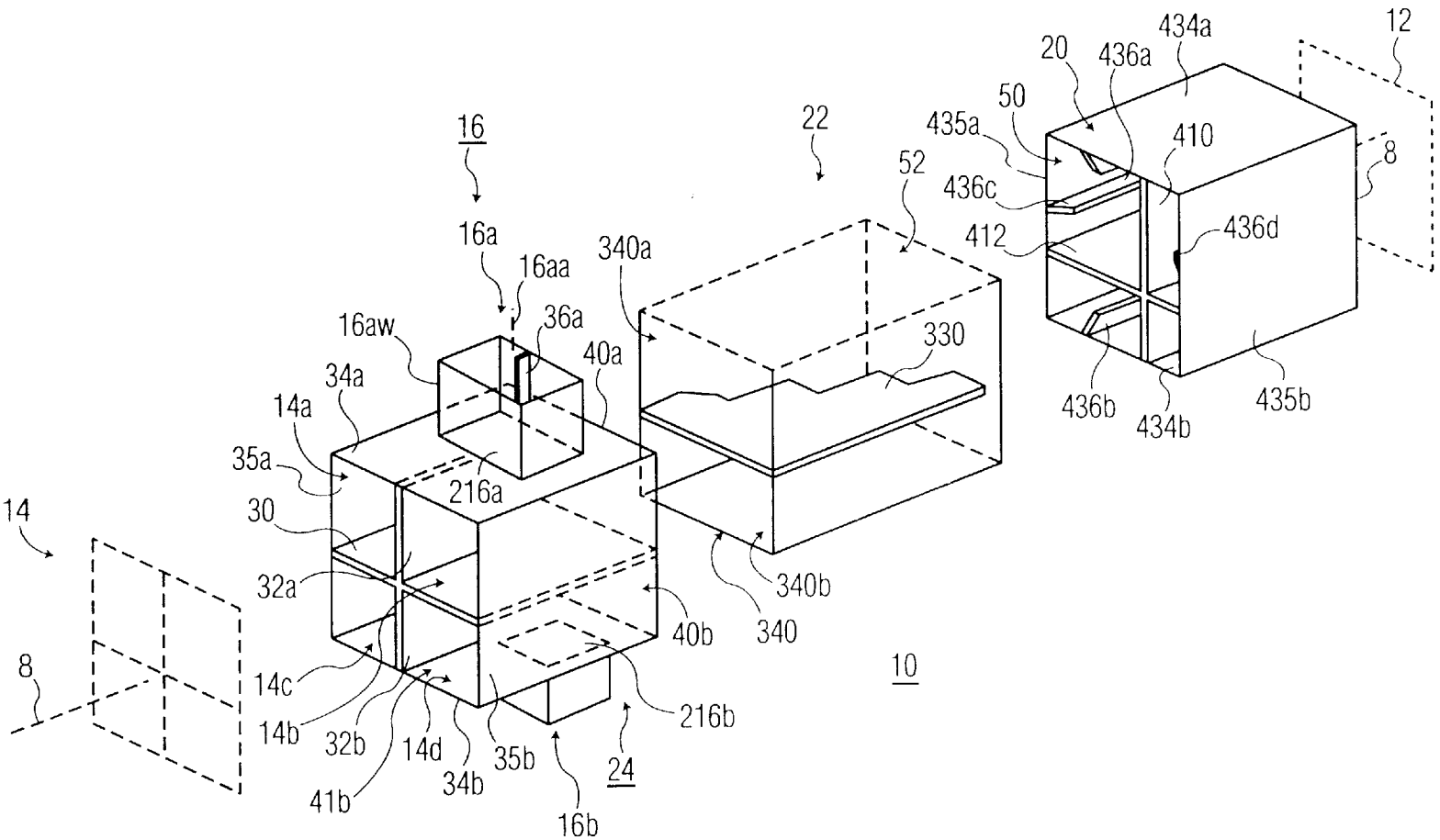
FIG. 1 is a simplified, exploded view of a coupler according to an aspect of the invention, illustrating a common square port, and mutually independent first and second external ports, where the first external port is in the form of a cluster of four square waveguides (wg), and the second external port is in the form of two rectangular ridged waveguides, and also including a square ridged waveguide section coupled to the square common port, a branch section coupled to the first and second external ports, and a transition section lying between the ridged waveguide section and the branch section.

FIG. 1 is a simplified, conceptually exploded view of a coupler 10 according to an aspect of the invention, illustrating a common square port 12, and mutually independent first and second external ports 14 and 16, respectively, where the first external port 14 is in the form of a cluster of four square waveguides ports 14*a*, 14*b*, 14*c*, and 14*d*. In this context, the term "waveguide" includes hollow structures including electrically conductive walls, for propagation of electromagnetic waves, and the term does not include other kinds of waveguides such as coaxial cable, stripline, and the like. The second external port 16 is in the form of two rectangular ridged waveguides 16*a* and 16*b*. The coupler 10 also includes a square ridged waveguide section 20 which is coupled to the square common port 12, a branch section 24 coupled to the first and second external ports 14 and 16, and a transition section 24 lying between the ridged square waveguide section 20 and the branch section 24. An axis 8 of elongation or symmetry extends through the centers of sections 20, 22, and 24, and through externally accessible ports 12 and 14. In its ordinary application, the signals applied to, or taken from, external square port 12 are at both operating frequencies, as for example at both 4 and 6 GHz for 4/6 GHz operation. The higher frequency signals are coupled to and from external port 14 by way of four square waveguide sections, and the lower-frequency signals are applied to or taken from two ridged rectangular waveguides of external port 16. Those skilled in the art understand that devices such as coupler 10 are passive reciprocal devices, so that the operation of the device in a receiving mode can be understood from a description of the operation in the transmitting mode, and vice versa. The description is generally approached from whatever point of view is easiest to understand. Similarly, it will be understood that a port is not a separate entity independent of the structures to which it is attached. In the conceptually exploded view of FIG. 1, internal "ports" are formed where the structure is split. These ports are not externally available, and are for purposes of explanation only.

Figure 2A:
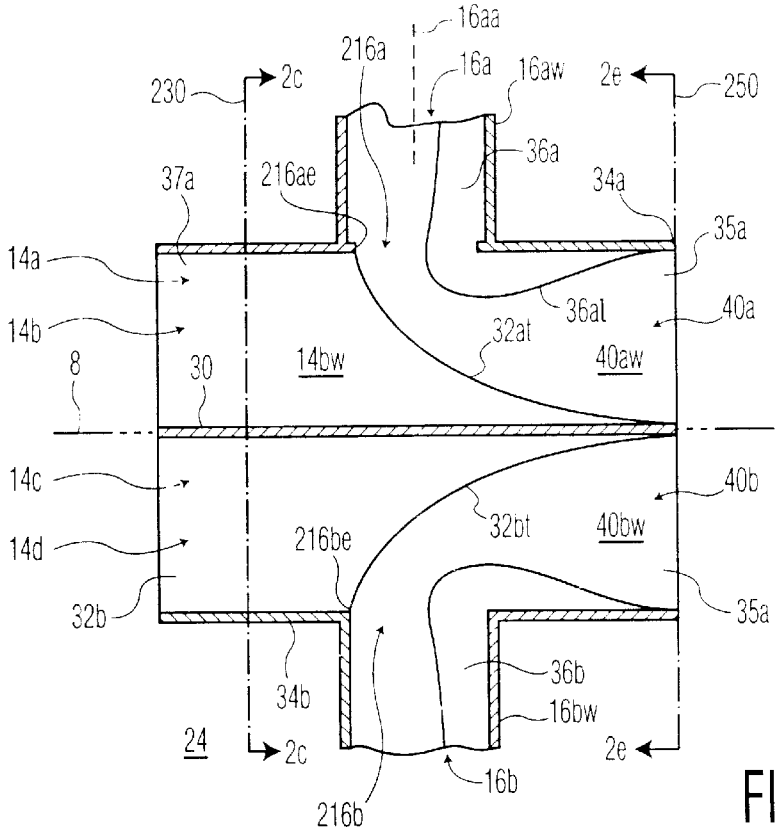
FIG. 2*a* is a simplified cross-sectional elevation view of the branch section of FIG. 1.
Figure 2B:
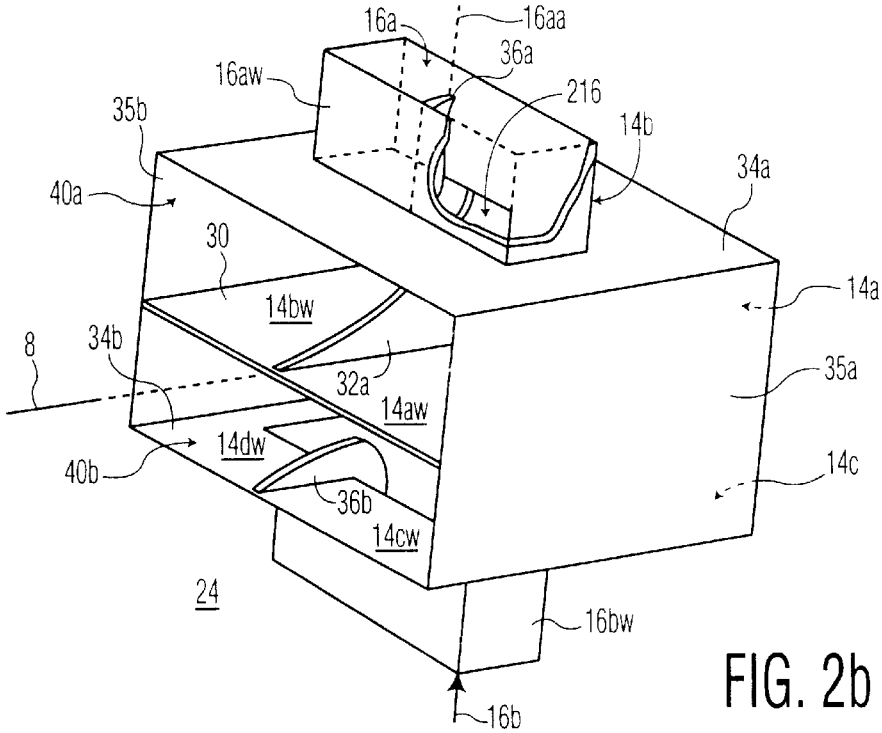
FIG. 2*b* is a simplified perspective or isometric view, looking into the side with internal ports, of the branch section of FIG. 1.

In FIG. 1, first external port 14 is illustrated in conceptual form a square port divided into four sub-ports, all centered on a coupler longitudinal axis 8. First external port 14 corresponds to the adjacent end structure of branch section 24. FIG. 2*a* is a simplified cross-sectional elevation view of the structure of branch section 24 of FIG. 1. In FIG. 2*a*, the structure is divided into symmetrical upper and lower portions by a common or joined wall 30. As illustrated at the left in FIG. 2*a*, the broad flat surfaces of the conductive septums 32*a* and 32*b* are visible, and obscure the view of wall 35*a*. It should be noted that wall 35*a* extends over, or is a part of, both rectangular waveguides 40*aw* and 40*bw*. Edge 32*at* of flat septum 32*a* extends from an edge 216*ae* of an aperture 216*a* to common wall 30 near a plane 250. To the right of tapered edge 32*at* of septum 32*a*, the internal surface of wall 35*a* is visible. Similarly, in the lower portion of the branch section 24 of FIG. 2*a*, the inner surface of wall 35*a* is visible at the right, but is obscured to the left of tapered edge 32*bt* of septum 32*b*. Edge portion 32*bt* of septum 32*b* extends from an edge 216*be* of aperture 216*b* to common wall 30 at a location near plane 250. FIG. 2*a* also illustrates by the dashed arrow that first clustered waveguide (wg) port 14*a* lies behind upper septum 32*a*, and by a solid arrow that second clustered wg port 14*b* lies on the near side of septum 32*a*. Similarly, the dashed arrow illustrates that third clustered wg port 14*c* lies behind lower septum 32*b* in the view of FIG. 2*a*, and the solid arrow illustrates that fourth clustered wg port 14*d* lies on the near side of septum 32*b*. Each square waveguide port 14*a*, 14*b*, 14*c*, and 14*d* may be understood to be associated with a square waveguide, designated 14*aw*, 14*bw*, 14*cw*, and 14*dw*, with surrounding conductive walls. As also illustrated in FIGS. 1 and 2*b*, the aperture 216*a* in upper H-plane wall 34*a* of branch section 24, which is associated with rectangular ridged waveguide port 16*a*, does not extend all the way across wall 34*a*, which is to say that it does not extend across the combined width of square waveguides 14*a* and 14*b*. Similarly, the aperture 216*b* associated with rectangular ridged waveguide port 16*b* does not extend all the way across the combined widths of square waveguides 14*c* and 14*d*.

Figure 2C:
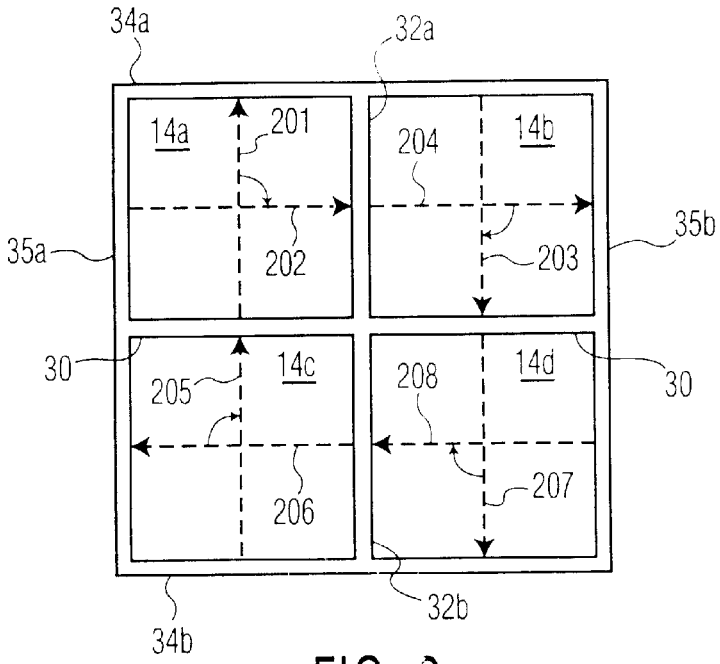
FIG. 2*c* is a representation of possible electric field directions within the four-waveguide portion of the structure of FIG. 2*a*, looking in the direction 2*c*—2*c*.

FIG. 2*c* illustrates possible electric field distributions in the four clustered square waveguides 14*a*, 14*b*, 14*c*, and 14*d*. The possible electric field directions are illustrated as dashed arrows. As might be expected, each square waveguide is capable of sustaining electric fields in two mutually orthogonal directions. Thus, square waveguide 14*a* can sustain two separate electric fields, illustrated as 201 and 202, square waveguide 14*b* can sustain two separate electric fields, illustrated as 203 and 204, square waveguide 14*c* can sustain two separate electric fields, illustrated as 205 and 206, and square waveguide 14*d* can sustain two separate electric fields, illustrated as 207 and 208. Those skilled in the art know that the two linear polarizations illustrated for each square waveguide 14*a*, 14*b*, 14*c*, and 14*d* can be supported simultaneously in the form of circular or elliptical polarization in each waveguide, depending upon the magnitude ratio and phase shift therebetween. There is no difference, in principle, between circular and elliptical polarization, the one being a special case of the other. If the magnitudes of the two orthogonal components or fields are equal and the phase shift is 90°, the polarization is circular. In FIG. 2*c*, the direction of circularity is indicated by angular direction or rotation arrows. The directions of the arrows representing the electric fields of FIG. 2*c* are selected to indicate the polarities of the fields in a particular elliptical or circular polarization distribution. Within any one square waveguide 14*a*, 14*b*, 14*c*, or 14*d*, the instantaneous electric field distribution can be represented by one-half cycle of a sinusoid, corresponding to a $TE_{1,0}$ field distribution.

Figure 2D:
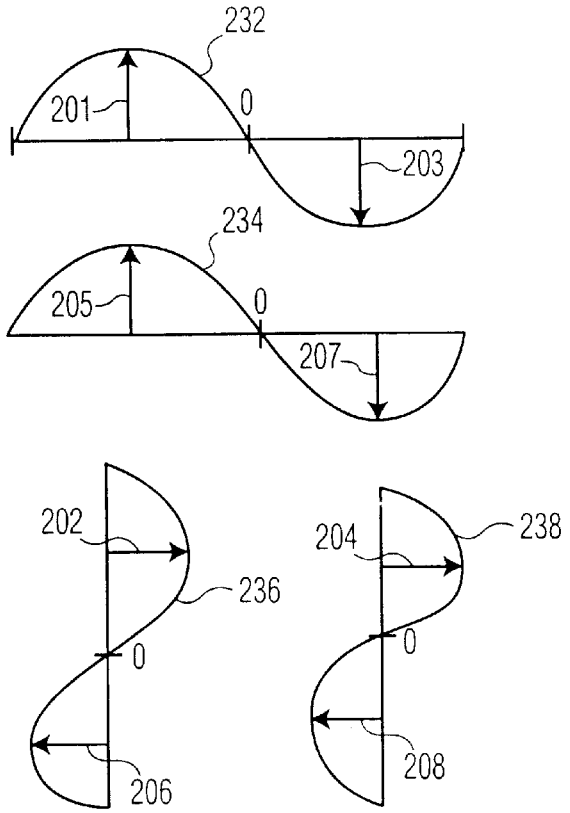
FIG. 2*d* illustrates the 3cumulative effect of various ones of the electric fields illustrated in FIG. 2*c*.

FIG. 2*d* illustrates the electric field distribution over pairs of the square waveguides for the vertically oriented field lines of FIG. 2*c* for operation in accordance with an aspect of the invention. More particularly, the distribution 232 of electric fields over square waveguides 14*a* and 14*b* is illustrated with respect to field lines 201 and 201. As can be seen, the distribution 232 has a zero crossing, representing zero field magnitude, at locations therebetween. It will be noted from FIG. 2*c* that electrically conductive septum 32*a* lies at the location of the zero crossing, and so the septum 32*a* has no effect on simultaneous propagation of electric fields represented by lines 201 and 203. Similarly, the distribution 234 of electric fields over square waveguides 14*c* and 14*d* is illustrated with respect to field lines 205 and 207. As can be seen, the distribution 234 has a zero crossing, representing zero field magnitude, at locations therebetween. It will be noted from FIG. 2*c* that electrically conductive septum 32*b* lies at the location of the zero crossing, and so the septum 32*b* has no effect on simultaneous propagation of electric fields represented by lines 205 and 207. Nevertheless, field lines 201 and 205 are in the same direction and would be additive in the absence of, or but for, common or joined wall 30, and field lines 203 and 207 are similarly in the same direction and would be additive in the absence of the same common wall 30.

FIG. 2*d* also illustrates the electric field distribution over pairs of the square waveguides for the horizontally disposed electric field lines of FIG. 2*c*. More particularly, the distribution 236 of electric fields over square waveguides 14*a* and

14*c* is illustrated with respect to field lines 202 and 206. As can be seen, the distribution 236 has a zero crossing, representing zero field magnitude, at locations therebetween. It will be noted from FIG. 2*c* that electrically conductive common wall 30 lies at the location of the zero crossing of distribution 236, and so the common wall 30 has no effect on simultaneous propagation of electric fields represented by lines 202 and 206. Similarly, the distribution 238 of electric fields over square waveguides 14*b* and 14*d* is illustrated with respect to field lines 204 and 208. As can be seen, the distribution 238 has a zero crossing, representing zero field magnitude, at locations therebetween. It will be noted from FIG. 2*c* that electrically conductive common wall 30 lies at the location of the zero crossing, and so the common wall 30 has no effect on simultaneous propagation of electric fields represented by lines 204 and 208. Nevertheless, field lines 202 and 204 are in the same direction and would be additive in the absence of septum 32*a*, and field lines 206 and 208 are similarly in the same direction and would be additive but for septum 32*b*.

Figure 2E:
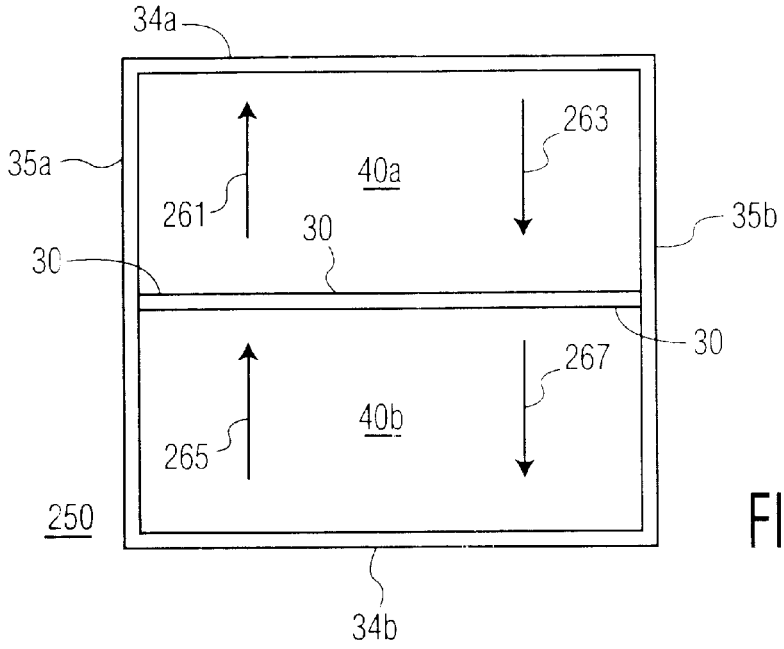
FIG. 2*e* illustrates the electric field distribution at the right of the branch section illustrated in FIG. 2*a* in response to signals applied to the cluster of four waveguides of the first external port.

The branch or branching section 24 of FIGS. 2*a*, 2*b*, and 2*c* includes a transition between pairs 14*a*, 14*b* of square waveguides to a "double-width" or rectangular guide 40*aw*, represented by third internal rectangular waveguide port 40*a*, and a similar transition between pairs 14*c*, 14*d* of square waveguides to a double-width rectangular guide 40*bw*, represented by fourth internal rectangular waveguide port 40*b*. This transition occurs as a result of the tapering of septums or septa 32*a* and 32*b* in the region between planes 230 and the right edge of branch section 24 (at plane 250) in FIG. 2*a*. That is to say, there are four square waveguides 14*a*, 14*b*, 14*c*, and 14*d* at the left of branch section 24 in FIG. 2*a* due to the presence of septums 32*a* and 32*b*, and two double-width rectangular waveguide sections at plane 250 at the right of branch section 24, since there septum has tapered to zero dimension at plane 250. The two double-width rectangular waveguide sections are illustrated in FIG. 2*e*. In FIG. 2*e*, electric fields 201, 203, 205, and 207 of FIG. 2*c* have been redesignated as 261, 263, 265, and 267, respectively, to thus indicate the difference in the waveguide in which they occur. Thus, the potential $TE_{2,0}$, $TE_{1,0}$ field distribution described in conjunction with FIGS. 2*c* and 2*d* is realized at plane 250 in each double-width rectangular waveguide. Again, it is noted that the field distributions described result from signal transmission in either direction through the coupler 10, and therefore occur whether transmission or reception of signals is taking place in the context in which the coupler 10 is used with an antenna. Viewed another way, the distribution 232 of electric fields 201 and 203 of FIG. 2*d*, when applied to rectangular waveguide 40*a* of FIG. 2*e*, corresponds to a $TE_{2,0}$ mode. When the electric fields 202 and 204 of FIG. 2*d* are applied to rectangular waveguide 40*a* of FIG. 2*e*, the two fields are additive, and correspond to a $TE_{0,1}$ mode. Similarly, when the distribution 234 of electric fields 205 and 207 of FIG. 2*d* is applied to rectangular waveguide 40*a* of FIG. 2*e*, the resulting distribution corresponds to a $TE_{2,0}$ mode, and the distributions 236, 238 of electric fields 206 and 208 of FIG. 2*d*, when applied to rectangular waveguide 40*b* of FIG. 2*e*, corresponds to a $TE_{0,1}$ mode.

In the branch coupler 24 of FIGS. 1, 2*a*, and 2*b*, the signal applied to port 16*a* of second external port 16 flows through a rectangular waveguide 16*aw* with ridge 36*a* to an aperture 216*a* defined in upper H-plane wall 34*a*. The aperture 216*a* is centered on the plane of septum 32*a*. The signal distribution within ridged rectangular waveguide 16*aw* tends to look like TEM mode distribution, with the free edge of ridge 36*a* the "center" of distribution. Thus, the fields tend to be concentrated near the center of the rectangular ridged waveguide 16*aw* as it or they arrive at aperture 216*a* in the H-plane wall 34*a*. Such a distribution would normally not couple well to the third internal rectangular waveguide port 40*a*, because of a tendency toward reflections at the edge of the aperture 216*a* and waveguide common wall 30. However, the presence of the tapered edge 32*at* of septum 32*a* provides a relatively low-reflection path for the flow of the electric fields from the ridged waveguide 16*aw* toward third internal rectangular waveguide port 40*a*. The electric fields tend to be concentrated between the lower edge 36*al* of ridge 36*a* and the upper edge 32*at* of the tapered portion of the septum. The ridge 32*a* tapers to zero amplitude at third internal port 40*a*, so the signal arriving at third internal port 40*a* from external port 16*a* assumes a $TE_{1,0}$ mode distribution with polarization shown as 60 in FIG. 2*f*. However, the presence of the septum 32*a* tends to short-circuit any of the principal electric fields entering port 16*a* which attempt to flow toward the waveguide cluster 14*a*, 14*b* associated with external port 14. In addition, in the illustrated embodiment for operation at disparate frequencies, each waveguide in the waveguide cluster 14*a* and 14*b* is a cutoff waveguide for the lower-frequency-band signal coming through waveguide 16*aw*, which aids in attenuating any lower-frequency signals attempting to propagate from port 16*a* toward external port 14. This cutoff characteristic tend to increase the isolation between ports 16*a* and 14 in the lower of the two frequency bands. Electromagnetic energy flowing from square waveguides 14*a*, 14*b* toward third internal rectangular waveguide port 40*a* is in the $TE_{1,0}$ or $TE_{2,0}$ mode shown in FIG. 2*e*, having a zero amplitude centered on the axis of ridged waveguide 16*aw*. This $TE_{1,0}$ mode has its electric fields polarized perpendicular to the narrow walls of waveguide 16*aw*, which are less than one-half wavelength ($\lambda/2$) long for any signals coming from port 14, so the waveguide 16*aw* is a cutoff waveguide for this $TE_{1,0}$ mode.

The electromagnetic energy flowing from square waveguide ports 14*a*, 14*b* of FIGS. 1 and 2*b* toward third internal rectangular waveguide port 40*a* in the $TE_{2,0}$ mode has a zero amplitude centered on the longitudinal axis 16*aa* of ridged waveguide 16*aw*, and the signals on either side of the ridge 36*a* are of mutually opposite polarity or phase relative to the ridge, so the $TE_{2,0}$ mode can excite only the high mode for which waveguide 16*aw* is cut off. Thus, a relatively high level of isolation can be expected between ports 14*a* and 16*a* for signals of the higher frequency band.

Thus, electromagnetic energy can readily flow between external port 16*a* and third internal rectangular waveguide port 40*a*, and between square waveguides 14*a*, 14*b* and third internal rectangular waveguide port 40*a*, but not between square waveguides 14*a*, 14*b* and external ridged waveguide port 16*a*. This action tends to make or render first external port 14 independent of second external port 16, in that signal tends not to flow between them. Those skilled in the art will realize, however, that this independence or isolation is never complete, and that coupling between the ports will occur at some level. Even 10 dB of isolation in the bands of interest, if achieved, can be very useful in some communication contexts. In the embodiment of the example, more than 30 dB of isolation can be readily achieved at the low frequency band, and with careful construction, 30 dB of isolation the high band can be achieved. The possibility of achieving such magnitudes of isolation opens the possibility of relaxing requirements placed on filters lying between the transmitter and receiver for purposes of providing isolation. This is especially important when the transmitter power is in the kilowatt range, in which situation 30 dB of isolation would reduce the transmitter signal arriving at the receiver input port to the range of one watt, which can more easily be handled by conventional filters.

Similarly, in the branch coupler 24 of FIGS. 1, 2*a*, and 2*b*, the signal applied to port 16*b* of second external port 16 flows through a rectangular waveguide 16*bw* with ridge 36*b* to an aperture 216*b* defined in lower H-plane wall 34*b*. The structure of port 16*b* relative to rectangular waveguide ports 14*c*, 14*d* is symmetrical or equivalent to that of port 16*a* relative to rectangular waveguide ports 14*a*, 14*b*, and the discussion set forth above applies equally thereto. In general, the aperture 216*b* is centered on the plane of septum 32*b*. The signal distribution within ridged rectangular waveguide 16*bw* tends to look like TEM mode distribution, with the free edge of ridge 36*b* the "center" of distribution. As described in conjunction with the upper half of branch section 24, the fields tend to be concentrated near the center of the rectangular ridged waveguide 16*aw* as it or they arrive at aperture 216*b* in the H-plane wall 34*b*. The presence of the tapered edge 32*bt* of septum 32*b* provides a relatively low-reflection path for the flow of the electric fields from the ridged waveguide 16*bw* toward fourth internal rectangular waveguide port 40*b*. The signals arriving at fourth internal port 40*b* from external port 16*b* tend to assume a distribution consistent with $TE_{1,0}$ mode. The presence of the septum 32*b* tends to short-circuit any of the principal electric fields entering port 16*b* which attempt to flow toward the waveguide cluster 14*c*, 14*d* associated with external port 14. Electromagnetic energy flowing from square waveguides 14*c*, 14*d* toward fourth internal rectangular waveguide port 40*b* is in the $TE_{2,0}$ mode, having a zero amplitude centered on the axis of ridged waveguide 16*bw*; this tends to allow little coupling. Thus, electromagnetic energy can readily flow between external port 16*b* and fourth internal rectangular waveguide port 40*b*, and between square waveguides 14*c*, 14*d* and fourth internal rectangular waveguide port 40*b*, but not between square waveguides 14*c*, 14*d* and external ridged waveguide port 16*b*.

Figure 2F:
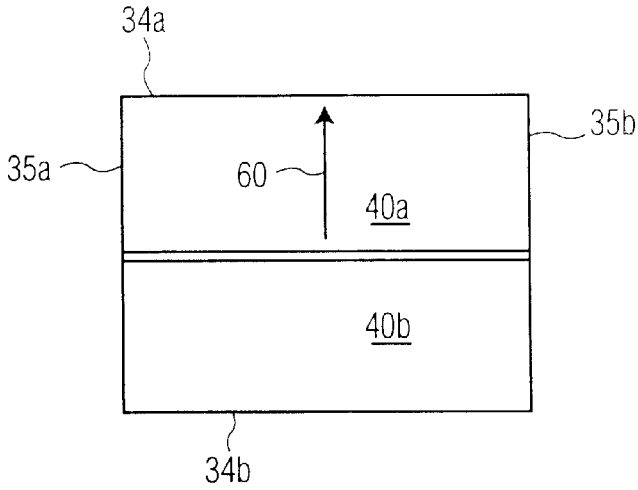
FIGS. 2*f*, 2*g*, 2*h*, and 2*i* illustrate the electric field distributions at the right of the branch section of FIG. 2*a* in response to various phases of signals applied to the first and second ridged waveguide ports of the second external port, respectively.
Figure 2G:
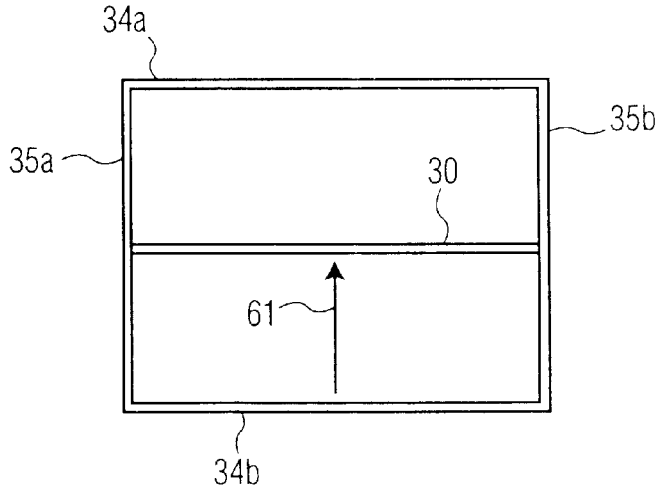
Figure 2H:
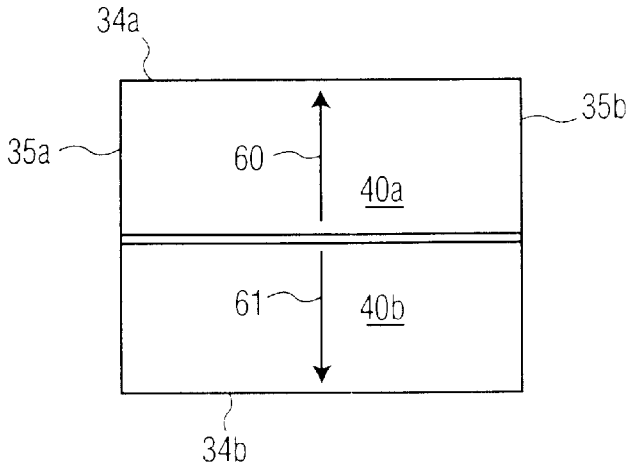
Figure 2I:
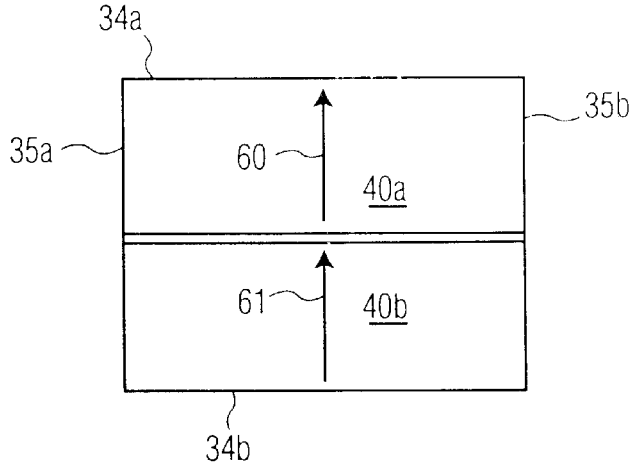
Figure 2J:
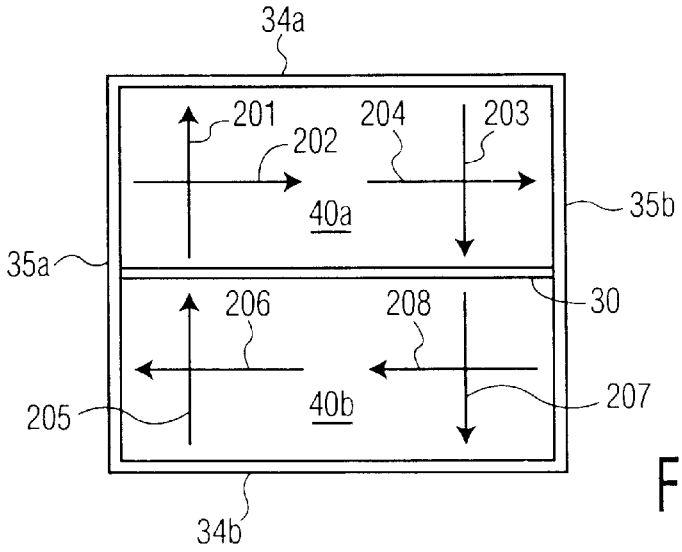
FIG. 2*j* illustrates the electric field distribution at the right of the branch section of FIG. 2*a* in response to signals applied to the two ridged waveguide ports of the second external port and to the four square waveguide ports of the first external port.

Rectangular ridged waveguides 16*aw* and 16*bw* of FIGS. 1, 2*a*, and 2*b* are each capable of supporting signal of a single polarization. When transmitting signals, the signals at ports 16*a* and 16*b* may be related or unrelated, depending upon what kind of polarization is required at external port 12. In the case of linear polarization, the signals at ports 16*a* and 16*b* may be excited either in-phase to obtain horizontal polarization at external port 12, or out-of-phase to obtain vertical polarization at external port 12, where in-phase means that, at a given cross-sectional location, the ridges 36*a* and 36*b* have the same polarity. In order to generate right or left circular polarization at port 12, only one of the ports 16*a* or 16*b*, respectively, is excited. FIG. 2*f* illustrates the polarity of the electric field lines 60 of the $TE_{1,0}$ mode in rectangular waveguide ports 40*a* and 40*b* when signal is applied to port 16*a* to ultimately generate right circular polarization at external port 12, and FIG. 2*g* illustrates the polarity of the electric field lines 61 of the $TE_{1,0}$ mode in rectangular waveguide ports 40*a* and 40*b* when signal is applied to port 16*b* to ultimately generate left circular polarization at external port 12. FIG. 2*h* illustrates the polarity of the electric field lines 60 and 61 in rectangular waveguide ports 40*a* and 40*b* when signal is applied to ports 16*a* and 16*b* to ultimately generate one polarity of linear polarization at external port 12, and FIG. 2*i* illustrates the polarity of the electric field lines 60 and 61 in rectangular waveguide ports 40*a* and 40*b* when signal is applied to ports 16*a* and 16*b* to ultimately generate the other polarity of linear polarization at external port 12. Thus, the first nominally independent external waveguide port 14, including four clustered square ports, generates electric fields 201, 202, 203, 204, 205, 206, 207, and 208, distributed as illustrated in FIG. 2*j*, at third and fourth internal ports 40*a* and 40*b* of the branch section 24, while second nominally independent external waveguide port 16, including two ridged rectangular waveguide ports 16*a* and 16*b*, generates one of the electric field distributions illustrated in FIGS. 2*f*, 2*g*, 2*h*, or 2*i*, depending on the presence and relative polarity of excitation. These three modes (two from 14*a* and 14*b*, one from port 16) propagate from internal ports 40*a* and 40*b* toward internal rectangular ports 340*a* and 340*b*, respectively of square port 340 of transition section 22 of FIG. 1.

Figure 3A:
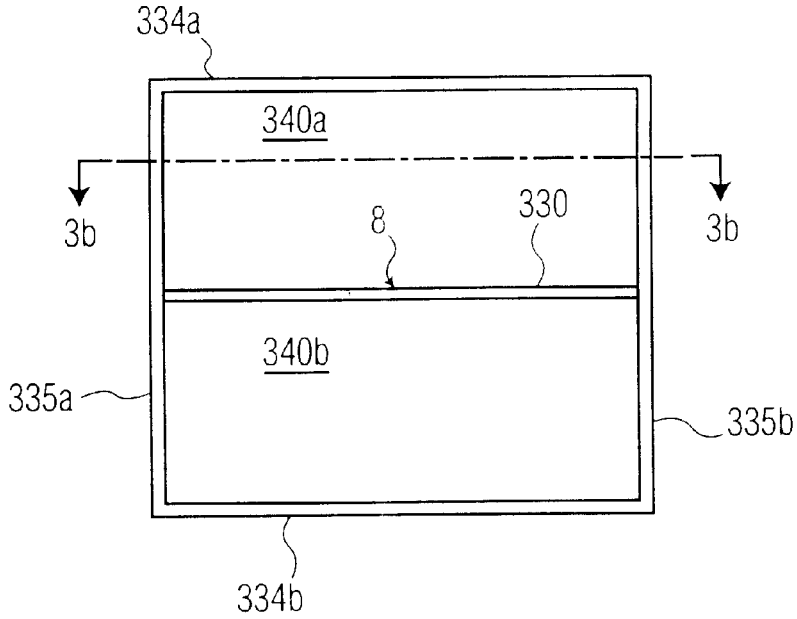
FIG. 3*a* is a simplified end view of the transition section illustrated in FIG. 1.
Figure 3B:
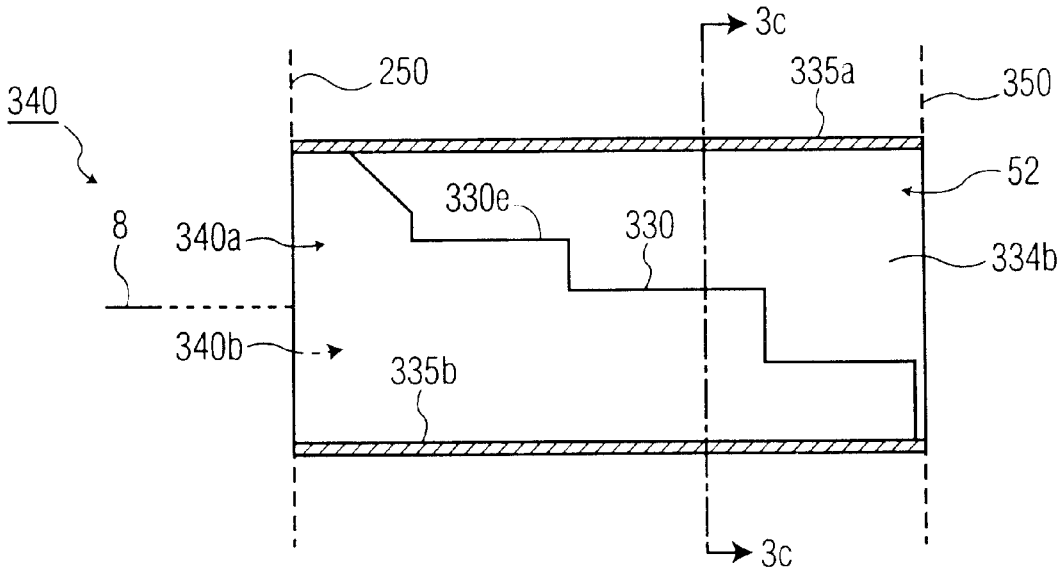
FIG. 3*b* is a cross-section thereof looking in the direction of section line 3*b*—3*b* of FIG. 3*a*.

Details of transition section 22 of coupler 10 of FIG. 1 are illustrated in FIGS. 3*a* and 3*b*. Transition section 22 is a relatively simple and well-known classical septum polarizer. The end view of FIG. 3*a* is taken looking along axis 8, into the first and second internal rectangular waveguide ports 340*a* and 340*b* of FIG. 1, which together make up internal square waveguide port 340. As illustrated, the square waveguide defined by external conductive walls 334*a*, 334*b*, 335*a*, and 335*b* is divided into two portions by a horizontally disposed septum 330. As can be seen in FIG. 3*b*, the septum 330 is tapered in a stepwise fashion from full width at plane 250 to zero width at locations near a plane 350. An internal square waveguide port 52 of transition section 22 lies at plane 350. As mentioned, the illustration of FIG. 1 is conceptually exploded, which means that in actuality branch section 24 is juxtaposed and joined with transition section 22 at plane 250. When so joined, the common or joined wall 30 of the branch section 24 seamlessly becomes, or transitions to, the septum 330 of transition section 22. Thus, there is no discontinuity between the third internal rectangular waveguide port 40*a* of the branch section and the first internal rectangular port 340*a* of the transition section 22, and there is similarly no discontinuity between the fourth internal rectangular waveguide port 40*b* and the second internal rectangular waveguide port 340*b*. The taper of the septum 330 of FIG. 3*b* results in a gradual "disappearance" of the septum along the transition section, viewing the progression of signal as being from left to right. The stepped structure is selected to reduce reflections at the steps, in known fashion. Instead of a stepped structure, a simple taper might suffice, and might provide better bandwidth than the stepped arrangement, but the taper could require more axial length to provide the same performance within a given frequency band.

It should be noted that septum 330 of FIGS. 3*a* and 3*b* lies at a location corresponding to that of common wall 30 of FIG. 2*j*, and thus is orthogonal to the direction of electric field lines 201, 203, 205, and 207 of FIG. 2*e*, and therefore has no effect except to terminate those field lines of signals originating from port 14. Also, the septum 330 of FIGS. 3*a* and 3*b* lies at zeros of the distribution of horizontally polarized electric field components 202, 204, 205, and 208 originating or flowing from external port 14, as described in conjunction with FIGS. 2*c* and 2*d*, and therefore has no effect on those electric field components either. Consequently, septum 330 of the transition section has no significant effect on the various modes originating from external port 14 which are propagating therethrough in the direction of axis 8. The gradual vanishing of the septum 330 along the axis 8 for signals progressing from left to right in FIG. 3*b* tends to gradually eliminate the separation between the modes illustrated in FIG. 2*d*, with the result that the signals arriving at the transition section (22 of FIG. 1, 3*a*, and 3*b*) from external port 14 (square waveguide ports 14*a*, 14*b*, 14*c*, and 14*d*) become $TE_{2,0}$ and $TE_{0,2}$ as they exit transition section 22 at internal rectangular waveguide port 52 at plane 350.

The septum 330 of transition section 22 of FIGS. 3*a* and 3*b* does, however, have an effect on the signals arriving at input ports 340*a* or 340*b* (at plane 250) of transition section 22 from ports 16*a* andor 16*b*. FIG. 2*f* illustrates the distribution of electric field lines of the signals arriving from port 16*a* at internal port 340*a* of transition section 22. The excitation of port 40*a* with unit magnitude and no excitation of port 40*b* is equivalent to simultaneous excitation of ports 40*a* and 40*b* in-phase as shown in FIG. 2I, with half-magnitude, together with simultaneous excitation of ports 40*a* and 40*b* as shown in FIG. 2*h*, also with half-magnitude. The mutually out-of-phase field lines 61 cancel to produce the zero excitation of port 40*b* of FIG. 2*f*, and the in-phase components 60 of FIGS. 2*h* and 2*i* add to produce the unit amplitude component 60 of port 40*a* of FIG. 2*f*.

Figure 3C:
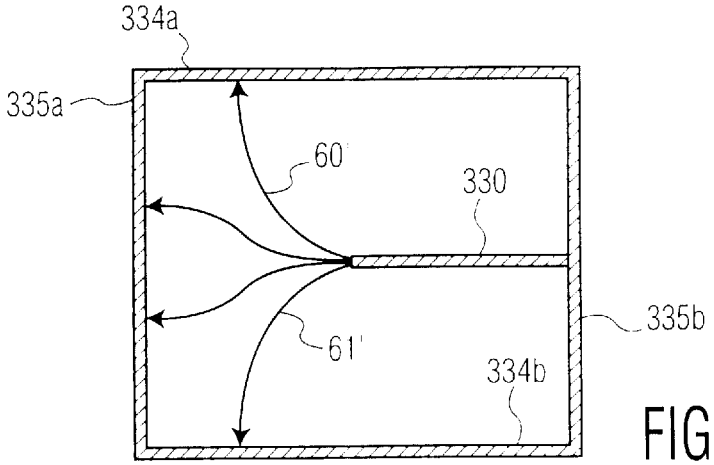
FIG. 3*c* is a representation of the effect of the septum of FIGS. 3*a* and 3*b* on the electric fields of FIGS. 2*f* and 2*g*.

It will be seen that the two illustrated field lines of FIG. 2I are in-phase and orthogonal to the septum 330, corresponding to a $TE_{1,0}$ mode, so the septum has no effect on these field lines. The modes with field lines 60, 61 of FIG. 2*i* propagate through transition section 22 without anything but normal propagation delay, and create single vertically polarized $TE_{1,0}$ mode with common field lines 60 plus 61 at internal port 52. If, however, the electric field signals generated at, or applied to, external ports 16*a* and 16*b* are out-of-phase, as illustrated in FIG. 2*h*, those two modes arrive at internal ports 340*a* and 340*b* with the polarities illustrated by 60 and 61 of FIG. 2*h*, and transform into a single combined $TE_{1,1}$ mode along the length of transition section 22, taking on a field configuration 60', 61' such as that illustrated in FIG. 3*c* along the transition. When the electric field lines 60 and 61 arrive at a location along the length of transition section 22 such as that illustrated in FIG. 3*c*, one end thereof, illustrated as the "tail" of the arrow in FIG. 3*c*, remains "attached" to the edge of the septum, and extends toward the exterior walls, in known fashion, and as illustrated by field lines 60' and 61' of FIG. 3*c*. Thus, as the transverse width of the septum 330 decreases with increasing distance toward the right in FIG. 3*b*, the two electric field lines 60' and 61' in FIG. 3*c* gradually become parallel and become horizontally polarized $TE_{0,1}$ mode 60'+61' as shown in FIG. 3*e*. In the process of transforming the oppositely-directed electric field lines 60 and 61 of FIG. 2*h* into the more parallel field lines 60'+61' of FIG. 3*c*, a physically longer path is traversed, namely the path represented by the edge 330*e* of FIG. 3*b*, which tends to delay the signals being transformed relative to the straight-through signals. Another way of looking at the mechanism by which the delay occurs is to note that signals propagating using the ridge 330 are traversing a transmission line having more capacitance than the straight-through transmission line, and this additional capacitance adds delay to the transmission path, in known fashion. However the delay mechanism is viewed, the net effect is that the transformed mode 60'+61" is delayed relative to the straight-through orthogonal mode 60+61. In order to get the circular polarization, the septum 330 must be designed such that the delay corresponds to 90° for signals in the lower frequency band. The same situation obtains for the case of excitation of port 16*b* for the opposite hand of circular polarization at internal port 52.

Figure 3D:
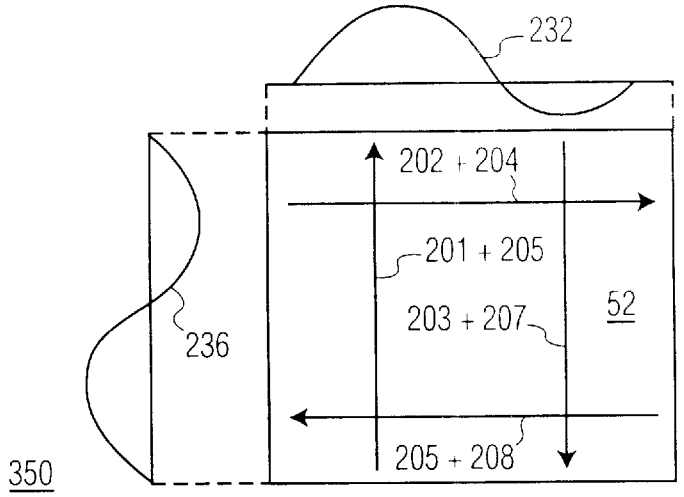
FIG. 3*d* is a representation of the electric field distribution at the right end of the transition section of FIG. 3*b* resulting from energization of the four clustered waveguides of the first external port.
Figure 3E:
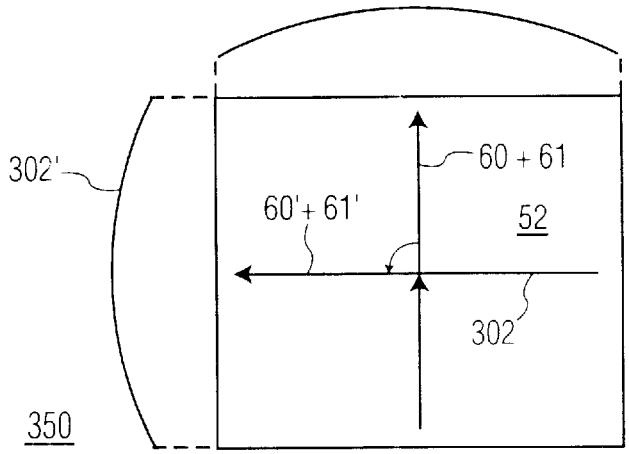
FIG. 3*e* is a representation of the electric field distribution at the right end of the transition section of FIG. 3*b* resulting from energization of the two ridged waveguides of the second external port of the coupler.

FIGS. 3*d* and 3*e* together illustrate the electric field distribution at port 52 of the transition section 22, at plane 350, for those signals applied to external ports 14 and 16, respectively. More particularly, FIG. 3*d* illustrates the electric field distribution at port 52 at plane 350 for the signals originating from, or applied to, external port 14. In FIG. 3*c*, the four electric field lines of two modes $TE_{2,0}$ and $TE_{0,2}$ are designated 202+204, 205+208, and 201+204, 205+208, respectively, corresponding to the corresponding field lines of FIG. 2*c*. Also, FIG. 3*e* illustrates the electric field distribution at port 52 of transition section 22 (at plane 350) resulting from application of signals to external port 16*a*. In FIG. 3*e*, the straight-through electric fields of two modes are designated $TE_{1,0}$ and $TE_{0,1}$ are designated 60+61, while the transformed signals are designated 60'+61', respectively. As illustrated, these two components are physically orthogonal, and as mentioned they are also mutually delayed. In effect, this constitutes the generation in transition section 22 of circular (or more properly, elliptical) polarization from the two linear polarization components illustrated in FIGS. 2*h* and 2*i*, or the single component of FIG. 2*f*.

Figure 4A:
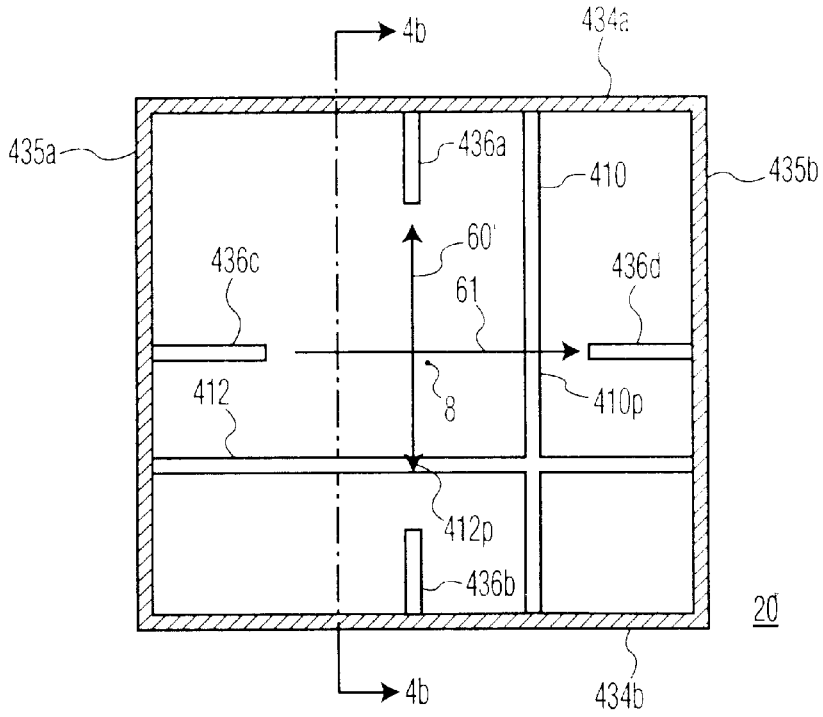
FIG. 4*a* is a simplified end view of the square ridged waveguide section, illustrating two mutually orthogonal ridge structures and two mutually orthogonal delay structures.
Figure 4B:
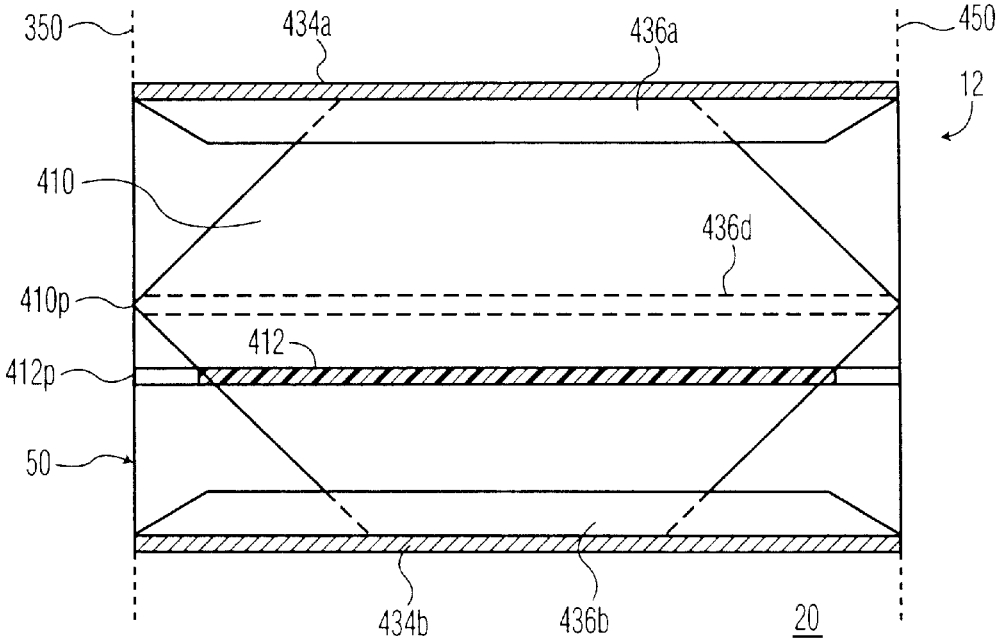
FIG. 4*b* is a simplified cross-sectional elevation view of the square ridged waveguide section of FIG. 4*a*, looking in the direction of section lines 4*b*—4*b*.

Ridged square waveguide section 20 of coupler 10 of FIG. 1 is illustrated in FIG. 4*a*, looking into internal square waveguide port 50, and in cross-section in FIG. 4*b*. As illustrated, ridged square waveguide section 20 includes a first set of ridges 436*a* and 436*b* attached to upper and lower walls 434*a* and 434*b*, respectively, for tending to concentrate vertically disposed (as illustrated in FIG. 4*a*) electric fields represented by field line 60', to tend to maintain the electric fields near the center of the structure and away from the side walls 435*a* and 435*b*. Similarly, ridged square waveguide section 20 includes a second set of ridges 436*c* and 436*d*, affixed to waveguide walls 435*a* and 435*b*, respectively, for tending to concentrate horizontally disposed electric fields, represented by field line 61' near the center of the structure, and to tend to maintain the fields remote from walls 434*a* and 434*b*. The ridges 436*a*, 436*b*, 436*c*, and 436*d* are at zeroes of the electric field distribution of the $TE_{2,0}$ and $TE_{0,2}$ modes (illustrated in FIG. 3*d*) exiting square port 52 of transition section 22 and entering square port 50 of ridged square waveguide section 20 at plane 350, and consequently have no effect on the signals originating from first external port 14 of FIG. 1. Thus, the $TE_{2,0}$ and $TE_{0,2}$ modes pass through ridged square waveguide section 20 unaffected by the ridges 436*a*, 436*b*, 436*c*, and 436*d*. On the other hand, ridged square waveguide section 20 includes a delay-type phase shifter, illustrated in FIGS. 4*a* and 4*b* as including a dielectric plate or slab 410, oriented vertically at a location which is away from the center of the structure (or any other type of phase shifter), so as not to affect the $TE_{1,0}$ and $TE_{0,1}$ mode fields entering port 50 of the ridged square waveguide section 20. The side location of dielectric-plate phase shifter 410 is selected to be near one of the two field maxima of the $TE_{2,0}$ mode, so that one polarization of the electric field is delayed relative to the other. Similarly, ridged square waveguide section 20 of FIGS. 4*a* and 4*b* includes a second dielectric-plate phase shifter 412, horizontally disposed at a location lying between ridges 436*c*, 436*d* and lower wall 434*b*, at a location away from the $TE_{0,1}$ mode peak amplitude, to avoid too much effect on that mode. Instead, dielectric slab 412 is located near one of the two peaks or peak amplitude portions of the $TE_{0,2}$ mode, and delays only that polarity of the signal. This has the effect of gradually transforming the $TE_{2,0}$ mode into the dominant $TE_{1,0}$ mode, and the $TE_{2,0}$ mode into the dominant $TE_{1,0}$ mode at the external port 12. As the $TE_{2,0}$ and $TE_{20,2}$ modes have an initial (plus or minus) 90° phase shift, the high frequency band signals are circularly polarized. It should be noted that the ridges 436*a*, 436*b*, 436*c*, and 436*d* are tapered near their ends to provide a gradual transition and thereby tend to reduce reflections, and the dielectric-plate phase shifters or delay elements 410, 412 are likewise tapered beginning at points 410*p* and 412*p*, and have like tapers at their ends remote from points 410*p* and 412*p*.

Figure 5:
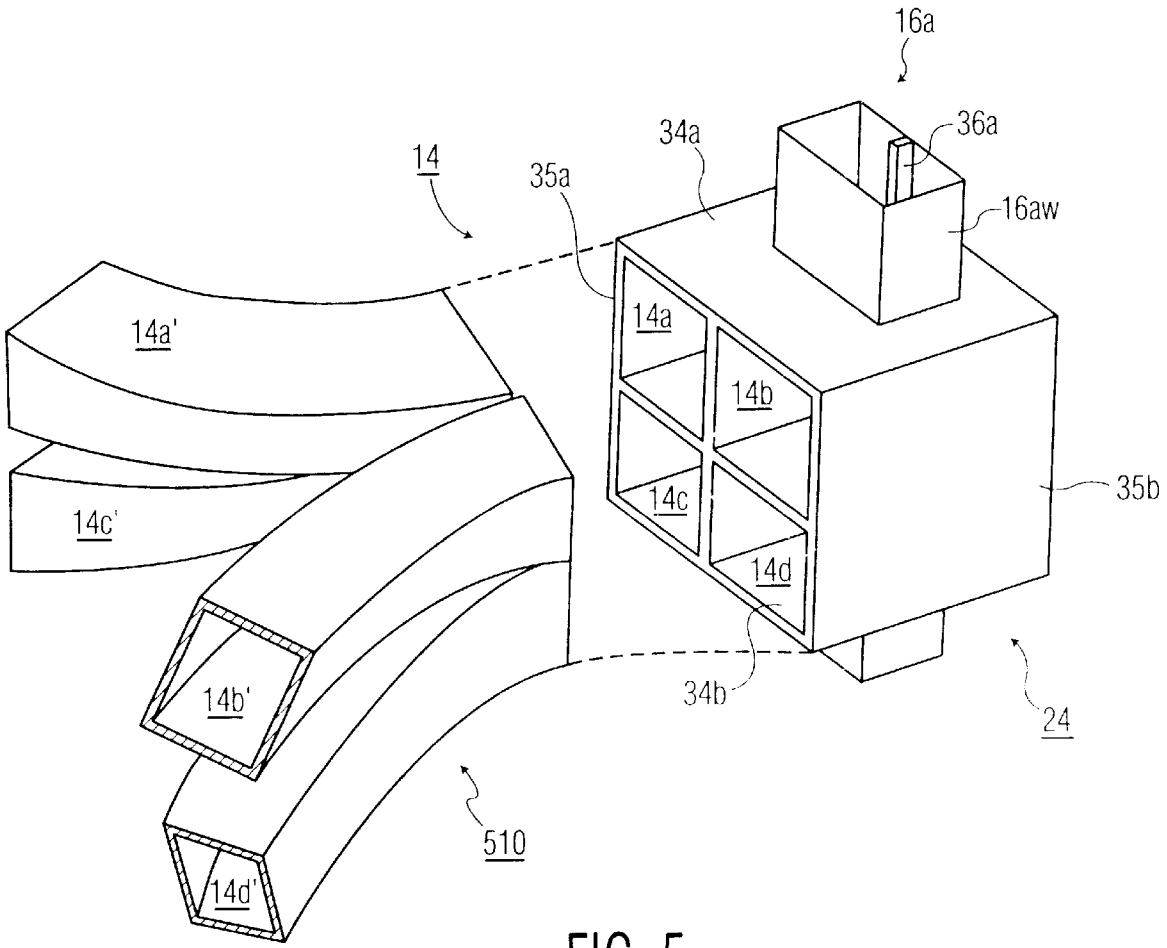
FIG. 5 is a simplified perspective or isometric view of the branch section of FIGS. 1, 2*a*, and 2*b*, together with a splaying square waveguide structure providing access for any type of feed or sink.

FIG. 5 is a simplified illustration of a general way to handle feed arrangements for the four clustered waveguide ports 14*a*, 14*b*, 14*c*, and 14*d* of external square port 14. In FIG. 5, a splaying or "trouser" arrangement designated as 510 is associated with external port 14 of branch section 24. The splaying arrangement is merely a set of four elongated square waveguides corresponding in dimension to the dimensions of the four square waveguides associated with ports 14*a*, 14*b*, 14*c*, and 14*d*, which match the clustered structure of the branch structure 24, and which diverge from each other at locations remote from the juncture with branch structure 24, to allow use of any desired type of feed. In FIG. 5, the four elongated splayed waveguides are designated 14*a*', 14*b*', 14*c*', and 14*d*'. Such a splaying arrangement tends to be heavy and mechanically inconvenient to handle.

Figure 6A:
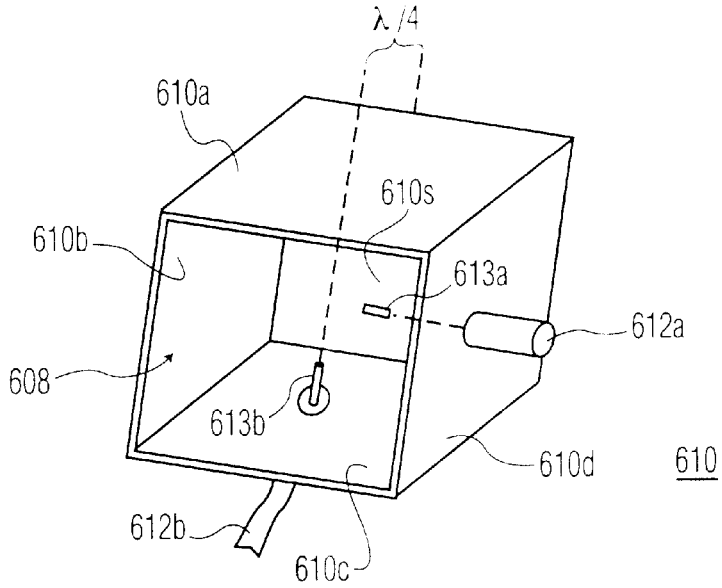
FIG. 6*a* is a simplified perspective or isometric view of one of the four clustered square waveguides of the branch section of FIG. 5, showing how a pair of probes can be physically applied.

FIG. 6*a* is a simplified perspective or isometric view of a square-waveguide feed structure 610 with square waveguide walls 610*a*, 610*b*, 610*c*, and 610*d*, defining a port 608. At a location about one quarter wavelength ($\lambda/4$) from a short-circuiting plate 610*s*, two coaxial transmission lines 612*a*, 612*b* terminate in electric probes 613*a*, 613*b*, respectively, projecting orthogonally into the square guide. Either of the coaxial transmission lines can be energized to thereby produce linearly polarized signal in the feed structure 610 for propagation from square port 608. If both coaxial lines are energized with a 90° phase shift, circularly polarized signal can be generated at the feed port 608. All that is required then is to couple such a feed structure 610 to one (or all) of the splayed waveguides 14*a*', 14*b*', 14*c*', and 14*d*' of FIG. 5 to provide the desired energization. A feed structure such as that of FIG. 6*a* is quite suitable at low powers and moderate bandwidths, as might be expected when performing a receiving function in a coupler such as that of FIG. 1.

Figure 6B:
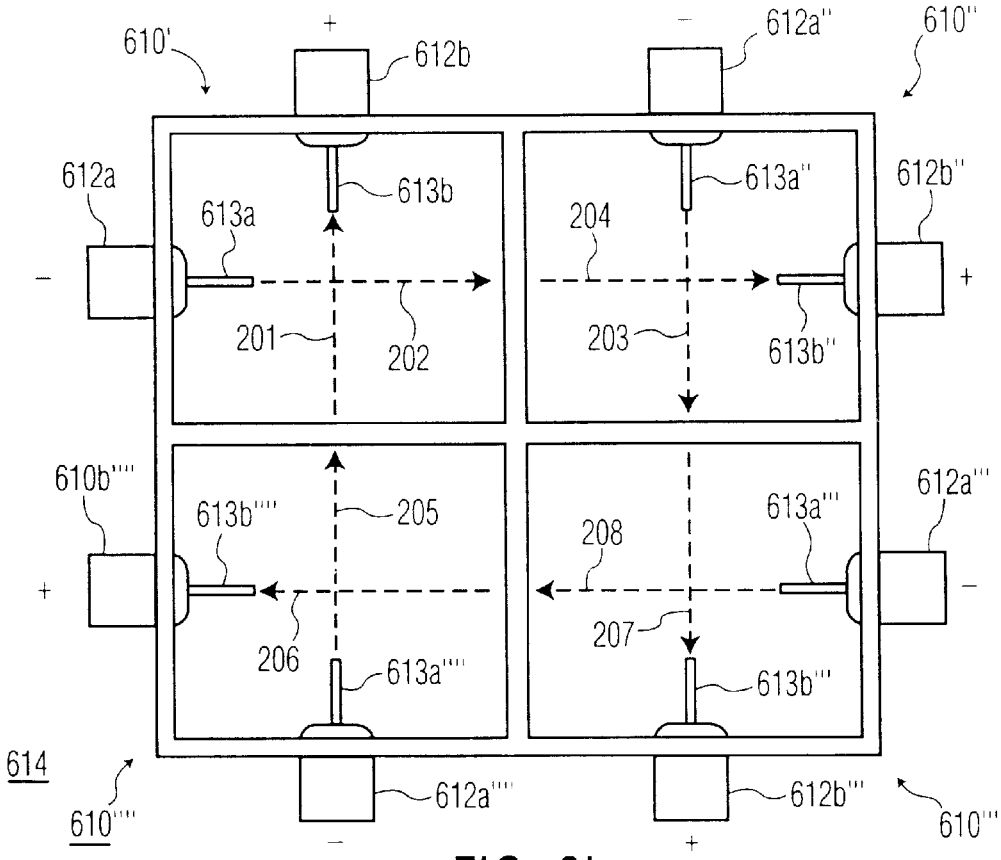
FIG. 6*b* is a simplified end view of a feed structure, using the probe structures of FIG. 6*a*, which is in the form of four clustered square waveguides which eliminates the need for the splaying arrangement of FIG. 5.

It turns out that a splaying arrangement such as 510 of FIG. 5 may not be necessary in some situations. For example, when feed structures such as 610 of FIG. 6*a* are used to generate the field distributions illustrated in FIG. 2*c*, some simplification may be possible. FIG. 6*b* illustrates in end view a cluster 614 of feed arrangements 610', 610", 610'", and 610"", each similar to that of FIG. 6*a*. In FIG. 6*b*, coaxial line 612*a* of feed structure 610' is fed with a relatively out-of-phase (−180°) signal to drive probe 613*a* to produce electric field component 202, and coaxial line 612*b* is fed with a relatively in-phase (0°) signal in order to drive probe 613*b* to produce electric field component 201. Simple rotation and translation of feed structure 610' of FIG. 6*b* produces feed structures 610", 610'", and 610"", which are mounted in a cluster as illustrated. The relative rotation of the feed structure 610' of cluster 614 allows the coaxial transmission lines to remain on the exterior of the structure 614, thereby avoiding the need for the splaying arrangement of FIG. 5. More particularly, in feed structure 614 of FIG. 6*b*, feed structure 610" includes two coaxial transmission lines 612*a*" and 612*b*" which terminate in probes 613*a*" and 613*b*", respectively, which project into the square waveguide of feed structure 610". Coaxial line 612*a*" is energized relatively out-of-phase, and coaxial line 612*b*" is energized relatively in-phase, so as to drive probes 613*a*" and 613*b*", respectively, to produce electric field lines 203 and 204, respectively. Similarly, in feed structure 614 of FIG. 6*b*, feed structure 610'" includes two coaxial transmission lines 612*a*'" and 612*b*'" which terminate in probes 613*a*'" and 613*b*'", respectively, which project into the square waveguide of feed structure 610'". Coaxial line 612*a*'" is energized relatively out-of-phase, and coaxial line 612*b*'" is energized relatively in-phase, so as to drive probes 613*a*'" and 613*b*'", respectively, to produce electric field lines 208 and 207, respectively, and feed structure 610"" includes two coaxial transmission lines 612*a*"" and 612*b*"" which terminate in probes 613*a*"" and 613*b*"", respectively, which project into the square waveguide of feed structure 610"". Coaxial line 612*a*"" is energized relatively out-of-phase, and coaxial line 612*b*"" is energized relatively in-phase, so as to drive probes 613*a*"" and 613*b*"", respectively, to produce electric field lines 205 and 206, respectively. Thus, a clustered feed structure is possible, for convenient fabrication, and for relatively small size and low cost.

Figure 6C:
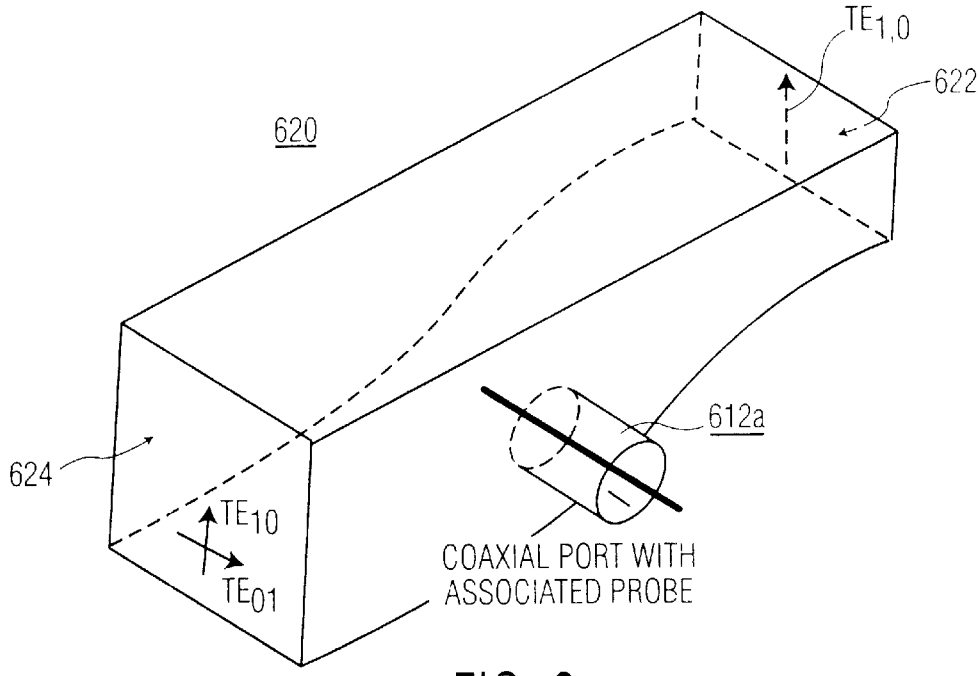
FIG. 6*c* represents an alternative feed structure for one square waveguide of the cluster of waveguides of the branch structure of FIG. 5, which includes a single probe port and an end waveguide port.
Figure 6D:
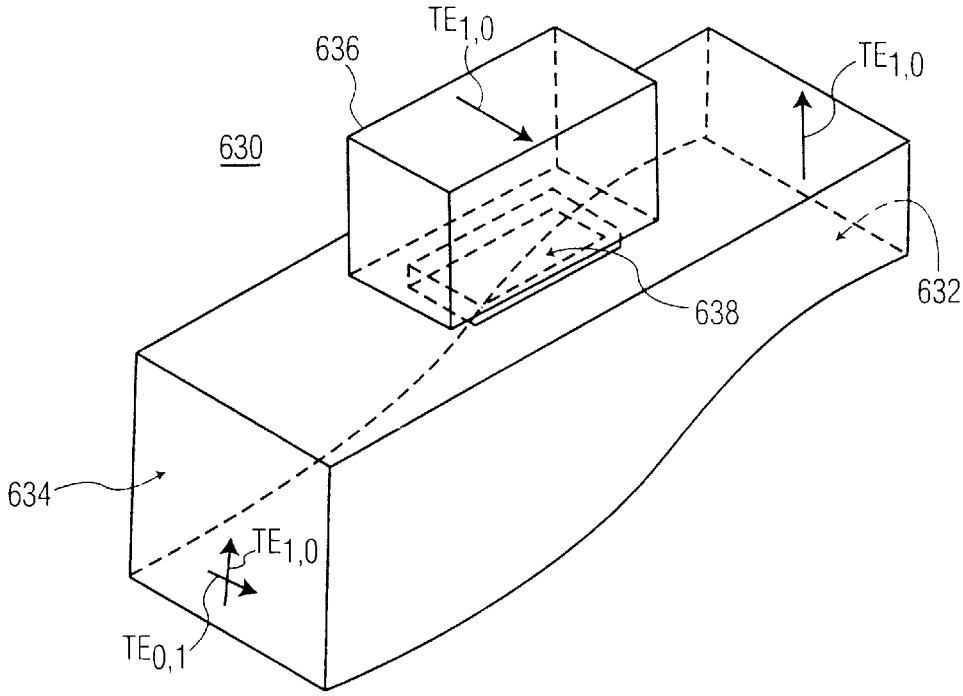
FIG. 6*d* is similar to FIG. 6*c*, but uses a waveguide port in an upper wall of the structure instead of a probe in a side wall.
Figure 6E:
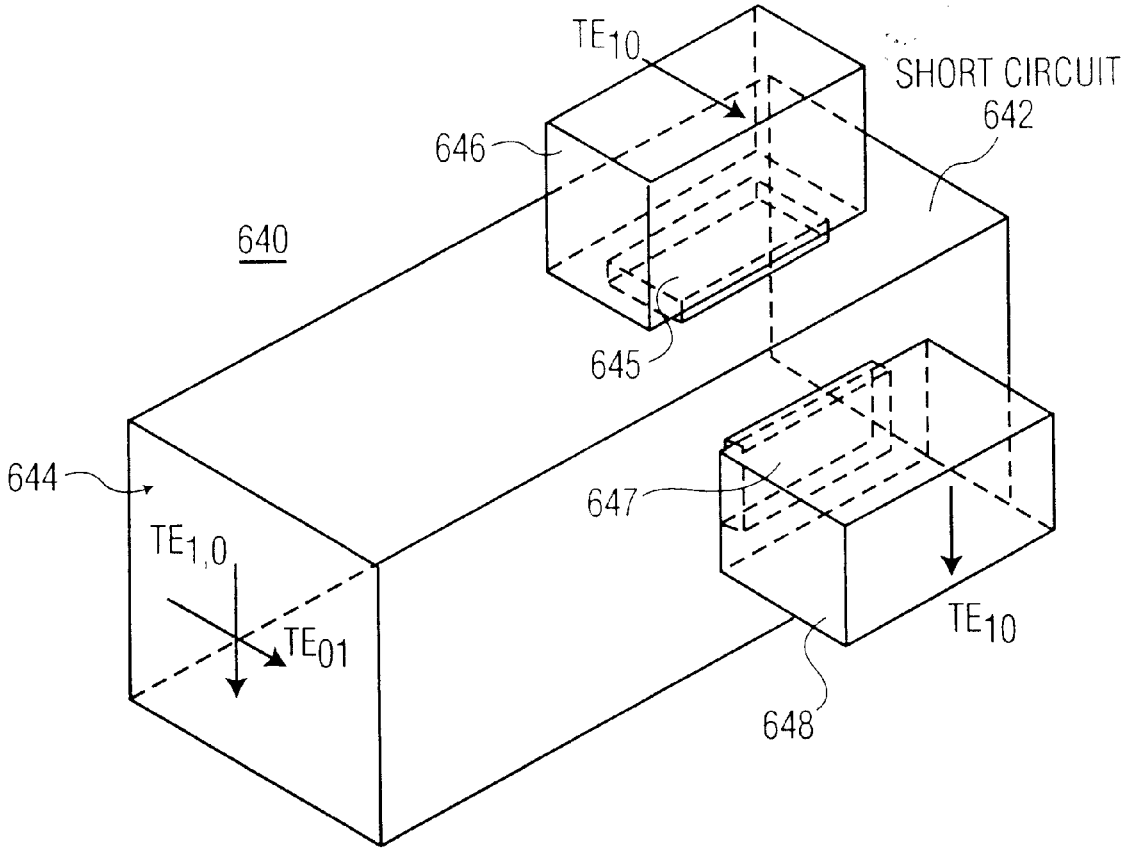
FIG. 6*e* is similar to FIG. 6*d*, but substitutes a further waveguide port in the side wall of the structure instead of the end waveguide port.

Other types of square waveguide feeds are possible. FIG. 6*c* illustrates a tapered rectangular-to-square waveguide arrangement 620 with a rectangular waveguide port 622 and a square waveguide port 624. A coaxial probe 612*a* projects into the side of the structure. The $TE_{1,0}$ component which appears at square port 624 originates from the rectangular waveguide port 622, while the $TE_{0,1}$ component originates from coaxial probe 612*a*. Another generally similar arrangement is illustrated in FIG. 6*d*. In FIG. 6*d*, a tapered square-to-rectangular waveguide arrangement 630 includes a rectangular port 632 to which $TE_{1,0}$ signal is applied. The taper takes this same signal to square port 634. A rectangular waveguide 636 is coupled to an aperture 638 in the upper wall of structure 630, and is energized with $TE_{1,0}$ signal. The signal passes through the aperture, and couples preferentially to the square port 634, because its polarization is not such as to be effectively supported by the rectangular port 632. Since the feed arrangement of FIG. 6*d* uses only waveguide, it tends to be more suitable for high-power applications that those using coaxial probes. In the arrangement of FIG. 6*d*, a stepped transition could be used instead of the illustrated taper. The feed structure of FIG. 6*e* includes a square waveguide section 640 with a square port 644. The end of waveguide section 640 remote from the port 644 is short-circuited with a plate 642. A first rectangular waveguide 646 couples $TE_{1,0}$ mode signal through an aperture 645 to produce $TE_{0,1}$ signal at the square aperture 644, and a second rectangular waveguide 648 couples $TE_{1,0}$ signal through an aperture 647 to produce $TE_{1,0}$ signal component at the square aperture. Many other types of square aperture feeds are known and may be used.

External common square port 12 of FIG. 1 can be coupled to an antenna or to any other structure by simple radiation directly from the port, or with the aid of a horn, as known in the art. In a reception mode, circularly polarized linear signals (of the lower frequency band) in $TE_{1,0}$+$TE_{0,1}$ modes pass through the ridged square waveguide section 20 without significant effect or loss, and are coupled to the transition section 22. In transition section 22, the circularly polarized signals are converted into linear signals with either in-phase or out-of-phase components, depending upon the hand of circularity of the receive signals. Thus, the signals appearing at external ports 16*a* are responsive to one hand of received circular polarization, and likewise the signals appearing at external port 16*b* are responsive to the other hand of received circular polarization. Linearly polarized, noncircular signals are also coupled through to ports 16*a* and 16*b*, with received signal being routed to port 16*a* and 16*b* simultaneously. In the case of linear polarization, the signals routed to ports 16*a* and 16*b* have equal magnitudes, out-of-phase for vertical polarization, and in-phase for horizontal polarization. The two $TE_{1,0}$+$TE_{0,2}$ modes of higher-band or higher-frequency received signals in square waveguide 12 pass through the ridged waveguide section 20, where they transform into $TE_{2,0}+TE_{0,2}$ modes which pass freely through the septum polarizer 22 to port 14.

Figure 4C:
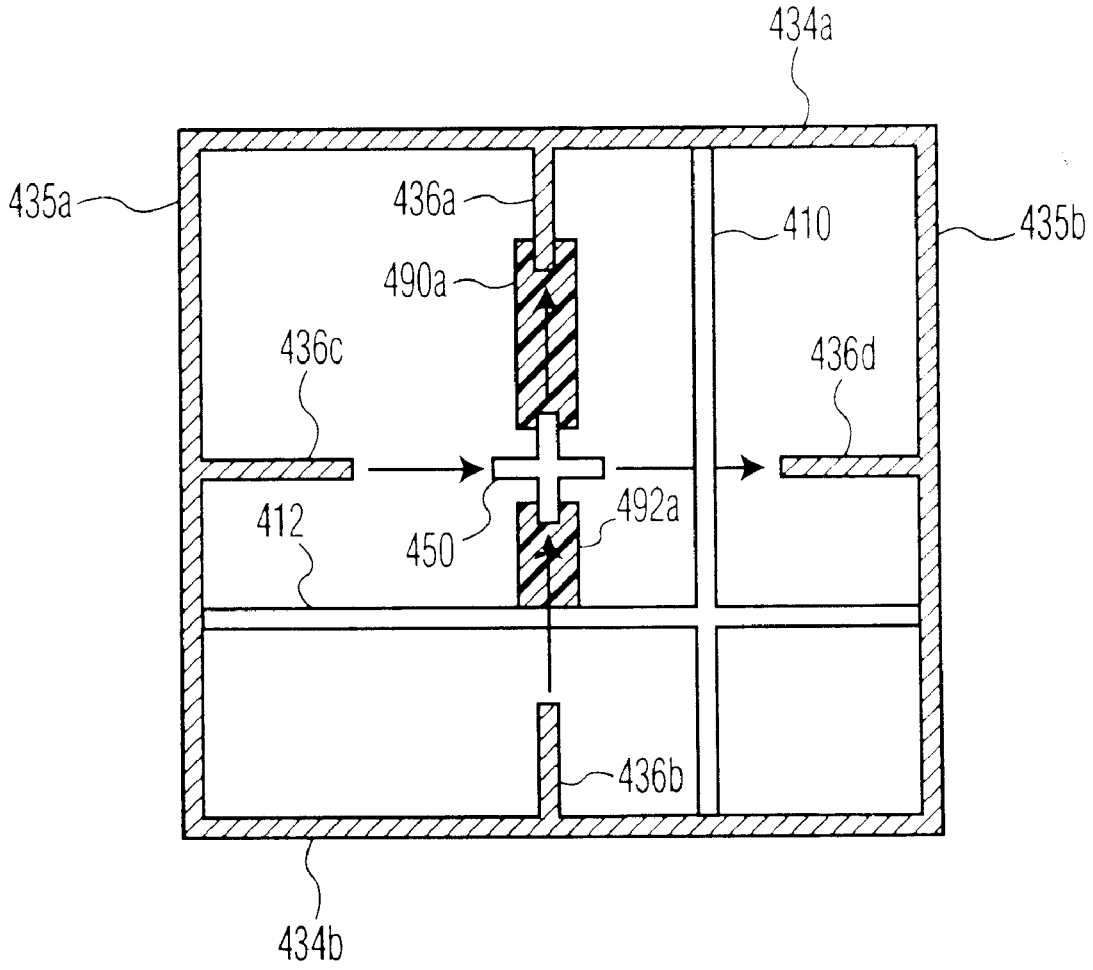
FIG. 4*c* is a simplified end view of an alternative embodiment of the square ridged waveguide section, in which the mutually orthogonal ridge structures include a centrally located element.

FIG. 4*c* illustrates an end view of a variant form of square ridged waveguide section 20 of FIG. 1. FIG. 4*c* is similar to FIG. 4*a*, but includes a central conductive section 450 of ridge. The central ridge portion 450 is in an "X" or cross form, having two mutually orthogonal ridge portions 450*a* and 450*b*, each of which is coplanar with one pair of ridges. The central ridge portion 450 tends to shorten the "span" of the electric field lines extending between ridge portions, to thereby tend to limit the spreading of the fields into regions which might be affected by the presence of phase shifters 410 and 412. This may have the effect of reducing cross-polarization components.

Other embodiments of the invention will be apparent to those skilled in the art. For example, while the terms "horizontal" and "vertical" have been used to describe field directions, these designations refer to the positions of the field lines in the illustrations, and not their actual orientation when the coupler is used. Similarly, the terms "upper" and "lower," and the like, are taken with respect to the drawings, and are not intended to indicate actual relative physical locations. While the term "feed" has been used, those skilled in the art of transmission lines and antennas know that a feed may actually be a sink of signal, and that the uses of the word are rooted partially in the history of antenna understanding, and partially in the common comprehension that explanation of a system using one direction of propagation is equivalent to that expressed in terms of the opposite direction of propagation.

In general, a coupler according to the invention couples signal by way of a cluster of four square waveguide ports at a high frequency band, or by way of a two ridged waveguide ports at a lower frequency band, to a common square port. The coupling path includes a branch coupler for combining the $TE_{2,0}$ and $TE_{0,2}$ high-band signals from the square ports with the $TE_{1,0}$ low-band signals from the two ridged ports. The branch coupler is coupled to a mode converter or transformer, which allows the $TE_{2,0}$ and $TE_{0,2}$ mode signals to pass through unchanged, and which converts the $TE_{1,0}$ mode signals from the two ridged ports to $TE_{1,0}$, $TE_{0,1}$ in a square port. A ridged square waveguide section couples the square port of the mode converter to the common square port. The ridged square waveguide section includes ridges and phase shifters which delay components of the high-band modes to produce $TE_{1,0}$ and $TE_{0,1}$ modes at the common port in both bands.

Looking at the structure of FIG. 1 on an overall basis, it may be understood from the foregoing description that the high-band (6 GHz in the example) signals flowing between transition section 22 and branch section 24, or in other words at internal ports 40*a*, 40*b*/340*a*, 340*b*, are in the $TE_{1,0}$ and $TE_{2,0}$ modes, while the signals flowing between these sections in the low band (4 GHz in the example) are in $TE_{1,0}+\pi$ mode. The high-band signals flowing between ridged square waveguide section 20 and transition section 22, at ports 50 and 52, are in the $TE_{2,0}+TE_{0,2}$ mode, and the low-band signals are in the $TE_{1,0}+TE_{0,1}$ mode. Both the high- and low-band signals at common square port 12 are in the $TE_{1,0}+TE_{0,1}$ mode.

Thus, a coupler (10) with mode transformer (22) according to an aspect of the invention is for coupling (a) a common square waveguide port (12) with at least one of nominally mutually independent (b) first external (14) and (c) second external (16) ports. The first external port (14) is in the form of a cluster of first (14*a*), second (14*b*), third (14*c*), and fourth (14*d*) clustered square waveguide ports. The second external port (16) is in the form of first (16*a*) and second (16*b*) rectangular ridged waveguide ports, which are associated with corresponding waveguides (16*aw*, 16*bw*). The first external port (14), in one embodiment, operates at a relatively high frequency band, namely 6 GHz, and the second external port (16) operates at a relatively low frequency band (4 GHz), while the common port (12) operates at both frequency bands. The common square waveguide (defined by walls 434*a*, 434*b*, 435*a*, and 435*b*) associated with the common square waveguide port (12), and each of the four square clustered waveguides (14*aw*, 14*bw*, 14*cw*, and 14*dw*) associated with the first external port (14), are capable of supporting either, or both, of two mutually orthogonal linear polarizations. In general, at any one time, one of the square waveguides (or its port) may support a first linear polarization, a second linear polarization orthogonal to the first, or either of two hands of circular or elliptic polarization which has as components such linear polarizations. The second external port (16) is in the form of first (16*a*) and second (16*b*) rectangular ridged waveguide ports, each of which is capable of supporting a single linear polarization, and each of which is associated with a corresponding ridged waveguide (16*aw*, 16*bw*). The common port (12) can couple signals with any of these polarizations with (or to) one or the other of the first (14) and second (16) nominally independent ports. The coupler (10) includes a ridged square waveguide section (20) defining a port coupled to, or in common with, the common square waveguide port (12) and also defining a first internal square port (50). The ridged square waveguide section (20) includes first (436*a*, 436*b*) and second (436*c*, 436*d*) mutually spatially orthogonal ridge structures lying between the first (12) and first internal square (50) ports of the ridged square waveguide section (20). These ridge structures (436*a*, 436*b*, 436*c*, 436*d*) tend to concentrate the fields of the dominant $TE_{1,0}$ mode of either of the two mutually spatially orthogonal linear polarizations in, or into, a region near the axis or center (8) of the ridged square waveguide section (20). The ridged square waveguide section (20) also includes first (410) and second (412) planar phase shifters. The first planar phase shifter (410) lies parallel to the plane of the first ridge structure (436*a*, 436*b*), and the second planar phase shifter (412) lies parallel with the plane of the second ridge structure (436*c*, 436*d*), so that the first (410) and second (412) planar phase shifters are mutually orthogonal. Each of the first (410) and second (412) planar phase shifters is located between that one of the ridge structures with which it is parallel (436*a*, 436*b*; 436*c*, 436*d*) and a side wall (435*b*;434*b*) of the ridged square waveguide section (20). The locations of the phase shifters (410, 412) are selected for propagating either polarization of the dominant $TE_{1,0}$ mode (normally associated with the low-band signals) from the first port to the second port of the ridged square waveguide section (20) without substantially affecting the dominant $TE_{1,0}$ mode, and for delaying by substantially $\pi$ a spatial portion of one of (a) a $TE_{2,0}$ and (b) a $TE_{0,2}$ mode propagating therein (normally associated with high-band signals), to thereby convert (at the high band) between the dominant $TE_{1,0}$ mode at the first port (port 12) of the square waveguide section (20) and the one of the (a) $TE_{20}$ and (b) $TE_{0,2}$ mode at the second port (50) of the square waveguide section (20). The coupler (10) includes a transition section (22) of waveguide. The transition section of waveguide (22) defines a first internal square waveguide port (52) which is coupled to the first, internal, square waveguide port (50) of the ridged square waveguide section (20), and also defines a second square waveguide internal port (340, defined by the combination of rectangular ports 340*a*, 340*b*). The transition section of waveguide (22) includes a first septum (333) extending completely across the square cross-section at the second internal port (340) of the transition section of waveguide (22) to thereby define first (340*a*) and second (340*b*) internal rectangular waveguide ports. The first septum (333) progressively reduces in size (becomes smaller) toward the first square waveguide port (52) of the transition section of waveguide (22). The transition section of waveguide (22) converts (at the high frequency band in the example) between either polarization of the $TE_{1,0}$ mode at the first internal square port (50) of the ridged waveguide section (20) and at least one of the $TE_{2,0}$ and $TE_{0,2}$ modes in the first (340*a*) and second (340*b*) internal rectangular ports of the transition section (22). The coupler further includes an eight-port waveguide branch section (24) defining the first (16*a*) and second (16*b*) rectangular ridged waveguide ports of the second nominally independent port (16) of the coupler (10). The branch section (24) also includes first (14*a*), second (14*b*), third (14*c*), and fourth (14*d*) clustered square waveguide ports of the first nominally independent port (14) of the coupler (10), and third (40*a*) and fourth (40*b*) internal rectangular waveguide ports having a common or joined wall (30). The third (40*a*) and fourth (40*b*) internal rectangular waveguide ports of the branch section (24) are coupled to the first (340*a*) and second (340*b*) internal rectangular waveguide ports of the transition waveguide section (22). The branch section (24) further defines first (34*a*) and second (34*b*) H-plane walls parallel with the common wall (30), a first E-plane rectangular aperture (216*a*) in the first H-plane wall (34*a*) which is coupled (by ridged waveguide 16*aw*) to the first rectangular waveguide port (16*a*) of the second nominally independent port (16) of the coupler (10), and a second rectangular aperture (216*b*) in the second H-plane wall (34*b*) which is coupled (by way of rectangular ridged waveguide 16*bw*) to the second rectangular waveguide port (16*b*) of the second nominally independent port (16) of the coupler (10). The branch section (24) further includes a second septum (32*a*) extending from that edge (216*ae*) of the first rectangular aperture (216*a*) which is adjacent the first nominally independent waveguide port (14) to the first nominally independent waveguide port (14), to thereby aid in defining the first (14*a*) and second (14*b*) clustered square waveguide ports, and further includes a third septum (32*b*) extending from that edge (216*be*) of the second rectangular aperture (216*b*) which is adjacent the first nominally independent waveguide port (14) to the first nominally independent waveguide port (14), to thereby aid in defining the third (14*c*) and fourth (14*d*) clustered square waveguide ports.

In a particular avatar of this aspect of the invention, the coupler (10) includes a first rectangular waveguide section (16*aw*) extending from the first rectangular aperture (216*a*) to the first rectangular waveguide port (16*a*) of the second nominally independent port (16) of the coupler (10). This particular avatar also includes a third ridge (36*a*) which extends through the first rectangular aperture (216*a*) on that side of the first rectangular aperture (216*a*) which is remote from the first nominally independent waveguide port (14). This third ridge (36*a*) extends, in contact with a wall (34*a*) of the first rectangular waveguide section (40*aw*) at least part-way from the first rectangular waveguide aperture (216*a*) to the first rectangular waveguide port (40*a*). A variant of this particular avatar has the third ridge (36*a*) extending, in contact with the first H-plane wall (34*a*), from the first rectangular aperture (216*a*) toward the first rectangular internal port (40*a*) of the branch section (24).

In another avatar of this aspect of the invention, the first rectangular aperture (216*a*) in the first H-plane wall (34*a*) of the branch section (24) of the coupler (10) has at least one of height and width dimensions, in a direction transverse to the direction of propagation therethrough, less than the corresponding dimension of the third internal rectangular waveguide port (40*a*).

The second septum (32*a*) of the branch section (24) of the coupler (10) may include a tapered portion (32*at*) extending generally across, but not in contact with, the first rectangular aperture (216*a*) in the first H-plane wall (34*a*). This second septum (32*a*) may be in contact with the common wall (30) of the waveguide (40*aw*) associated with the third internal rectangular waveguide port (40*a*).

The ridge structure (436*a*, 436*b*, 436*c*, and 436*d*; 450) of ridged square waveguide section (20) of the coupler (10), in a region lying between the first or external port (12) and the first internal port (50) of the ridged square waveguide section (20) may include first (436*a*) and second (436*b*) mutually coplanar ridge portions in electrical contact with mutually opposed walls (434*a*, 434*b*) of the ridged square waveguide section (20). In a particular variant, the first ridge structure (436*a*, 436*b*; 450) lying between the first (12) and first internal (50) ports of the ridged square waveguide section (20) further comprises a third planar ridge portion (part of ridge structure 50) coplanar with the first (436*a*) and second (436*b*) mutually coplanar ridge portions, which third planar ridge portion (part of 450) is centered (on axis 8) in the ridged square waveguide section (20) and not in electrical contact with any wall of the ridged square waveguide section (20). This third planar ridge portion (part of 450) may be supported by a dielectric support structure (490*a*, 490*b*). In one hypostasis of the invention, the planar phase shifter (410, 412) is in the form of a dielectric plate.

What is claimed is:

1. A coupler with mode transformer, for coupling (a) a common square waveguide port supporting at least one of two mutually spatially orthogonal linear polarizations with at least one of nominally mutually independent (b) first external and (c) second external ports, said first external port being in the form of a cluster of first, second, third, and fourth clustered square waveguide ports, any one of which is capable of supporting at least one of two mutually spatially orthogonal linear polarizations, and said second external port being in the form of first and second rectangular ridged waveguide ports, each of which is capable of supporting a single linear polarization, said coupler comprising:

a ridged square waveguide section defining a first port coupled to said common square waveguide port and also defining a second port, said ridged square waveguide section including first and second mutually spatially orthogonal ridge structures lying between said first and second ports of said ridged square waveguide section, which ridge structures tend to concentrate the fields of either of two mutually spatially orthogonal linear polarizations in a region near the center of said ridged square waveguide section, said ridged square waveguide section also including first and second planar phase shifters, said first planar phase shifter lying parallel to said first ridge structure, and said second planar phase shifter lying parallel with said second ridge structure, so that said first and second planar phase shifters are mutually orthogonal, each of said first and second planar phase shifters being located between that one of said ridge structures with which it is parallel and a side wall of said ridged square waveguide section, for propagating a polarization distribution having a maximum near said center of said ridged square waveguide section from said first port to said second port of said ridged square waveguide section without substantial effect, and for delaying by substantially π a spatial portion of electromagnetic modes propagating therein having distribution maxima near said phase shifters;

a transition section of waveguide, said transition section of waveguide defining a first square waveguide port which is coupled to said second port of said ridged square waveguide section, said transition section of waveguide including a first septum extending completely across said square cross-section at said second port of said transition section of waveguide to thereby define first and second internal rectangular waveguide ports, said first septum progressively reducing in size toward said first square waveguide port of said transition section of waveguide, said transition section of waveguide being for converting between electromagnetic modes at said first port having components parallel with said septum and electromagnetic modes at said first and second internal rectangular waveguide ports which have field distributions orthogonal to the narrow sides of said first and second rectangular waveguide ports of said transition section; and an eight-port waveguide branch section defining said first and second rectangular ridged waveguide ports of said second nominally independent port of said coupler, said first, second, third, and fourth clustered square waveguide ports of said first nominally independent port of said coupler, and third and fourth internal rectangular waveguide ports having a common wall, said third and fourth internal rectangular waveguide ports of said branch section being coupled to said first and second internal rectangular waveguide ports of said transition waveguide section, said branch section further defining first and second H-plane walls parallel with said common wall, a first E-plane rectangular aperture in said first H-plane wall which is coupled to said first rectangular waveguide port of said second nominally independent port of said coupler, and a second rectangular aperture in said second H-plane wall which is coupled to said second rectangular waveguide port of said second nominally independent port of said coupler, said branch section further including a second septum extending from that edge of said first rectangular aperture which is adjacent said first nominally independent waveguide port to said first nominally independent waveguide port, to thereby aid in defining said first and second clustered square waveguide ports, and further including a third septum extending from that edge of said second rectangular aperture which is adjacent said first nominally independent waveguide port to said first nominally independent waveguide port, to thereby aid in defining said third and fourth clustered square waveguide ports.

2. A coupler with mode transformer, for coupling (a) a common square waveguide port supporting at least one of two mutually spatially orthogonal linear polarizations with at least one of nominally mutually independent (b) first external and (c) second external ports, said first external port being in the form of a cluster of first, second, third, and fourth clustered square waveguide ports, any one of which is capable of supporting at least one of two mutually spatially orthogonal linear polarizations, and said second external port being in the form of first and second rectangular ridged waveguide ports, each of which is capable of supporting a single linear polarization, said coupler comprising:

a ridged square waveguide section defining a first port coupled to said common square waveguide port and also defining a second port, said ridged square waveguide section including first and second mutually spatially orthogonal ridge structures lying between said first and second ports of said ridged square waveguide section, which ridge structures tend to concentrate the fields of the dominant $TE_{1,0}$ mode of either of said two mutually spatially orthogonal linear polarizations in a region near the center of said ridged square waveguide section, said ridged square waveguide section also including first and second planar phase shifters, said first planar phase shifter lying parallel to said first ridge structure, and said second planar phase shifter lying parallel with said second ridge structure, so that said first and second planar phase shifters are mutually orthogonal, each of said first and second planar phase shifters being located between that one of said ridge structures with which it is parallel and a side wall of said ridged square waveguide section, for propagating either polarization of said dominant $TE_{1,0}$ mode from said first port to said second port of said ridged square waveguide section without substantially affecting said dominant $TE_{1,0}$ mode, and for delaying by substantially π a spatial portion of one of (a) a $TE_{20}$ and (b) a $TE_{0,2}$ mode propagating therein, to thereby convert between said dominant $TE_{1,0}$ mode at said first port of said square waveguide section and said one of sa*i (a) $TE_{20}$* and (b) $TE_{0,2}$ mode at said second port of said square waveguide section;

a transition section of waveguide, said transition section of waveguide defining a first square waveguide port which is coupled to said second port of said ridged square waveguide section, said transition section of waveguide including a first septum extending completely across said square cross-section at said second port of said transition section of waveguide to thereby define first and second internal rectangular waveguide ports, said first septum progressively reducing in size toward said first square waveguide port of said transition section of waveguide, said transition section of waveguide being for converting between said either polarization of said $TE_{1,0}$ mode at said second port of said ridged waveguide section and the $TE_{1,0}$ mode in said first and second internal rectangular ports of said transition section; and an eight-port waveguide branch section defining said first and second rectangular ridged waveguide ports of said second nominally independent port of said coupler, said first, second, third, and fourth clustered square waveguide ports of said first nominally independent port of said coupler, and third and fourth internal rectangular waveguide ports having a common wall, said third and fourth internal rectangular waveguide ports of said branch section being coupled to said first and second internal rectangular waveguide ports of said transition waveguide section, said branch section further defining first and second H-plane walls parallel with said common wall, a first E-plane rectangular aperture in said first H-plane wall which is coupled to said first rectangular waveguide port of said second nominally independent port of said coupler, and a second rectangular aperture in said second H-plane wall which is coupled to said second rectangular waveguide port of said second nominally independent port of said coupler, said branch section further including a second septum extending from that edge of said first rectangular aperture which is adjacent said first nominally independent waveguide port to said first nominally independent waveguide port, to thereby aid in defining said first and second clustered square waveguide ports, and further including a third septum extending from that edge of said second rectangular aperture which is adjacent said first nominally independent waveguide port to said first nominally independent waveguide port, to thereby aid in defining said third and fourth clustered square waveguide ports.

3. A coupler according to claim 2, further comprising;

a first rectangular waveguide section extending from said first rectangular aperture to said first rectangular waveguide port of said second nominally independent port of said coupler;

a third ridge which extends through said first rectangular aperture on that side of said first rectangular aperture which is remote from said first nominally independent waveguide port, said ridge extending in contact with a wall of said first rectangular waveguide section at least part-way from said first rectangular waveguide aperture to said first rectangular waveguide port.

4. A coupler according to claim 3, wherein said third ridge extends, in contact with said first H-plane wall, from said first rectangular aperture toward said first rectangular internal port of said branch section.

5. A coupler according to claim 2, wherein said first rectangular aperture in said first H-plane wall of said branch section has at least one of height and width dimensions less than the corresponding dimension of said third internal rectangular waveguide port.

6. A coupler according to claim 2, wherein said second septum includes a tapered portion extending generally across, but not in contact with, said first rectangular aperture in said first H-plane wall, and in contact with said common wall of said third internal rectangular waveguide port.

7. A coupler according to claim 2, wherein said first ridge structure lying between said first and second ports of said ridged square waveguide section comprises first and second mutually coplanar ridge portions in electrical contact with mutually opposed walls of said ridged square waveguide section.

8. A coupler according to claim 7, wherein said first ridge structure lying between said first and second ports of said ridged square waveguide section further comprises a third planar ridge portion coplanar with said first and second mutually coplanar ridge portions, which third planar ridge portion is centered in said ridged square waveguide section and not in electrical contact with any wall of said ridged square waveguide section.

9. A coupler according to claim 8, wherein said third planar ridge portion is supported by a dielectric support structure.

10. A coupler according to claim 2, wherein said planar phase shifter comprises a dielectric plate.

* * * * *